US010619516B2

(12) United States Patent
Shirota et al.

(10) Patent No.: US 10,619,516 B2
(45) Date of Patent: Apr. 14, 2020

(54) SUPPORT DEVICE, TURBINE, METHOD FOR ASSEMBLING ROTARY MACHINE, AND METHOD FOR DISASSEMBLING ROTARY MACHINE

(71) Applicant: MITSUBISHI HITACHI POWER SYSTEMS, LTD., Kanagawa (JP)

(72) Inventors: Akihiko Shirota, Kanagawa (JP); Takeki Nakayama, Kanagawa (JP); Taichi Ozaki, Kanagawa (JP)

(73) Assignee: Mitsubishi Hitachi Power Systems, Ltd., Kanagawa (JP)

( * ) Notice: Subject to any disclaimer, the term of this patent is extended or adjusted under 35 U.S.C. 154(b) by 262 days.

(21) Appl. No.: 15/559,156

(22) PCT Filed: Mar. 18, 2016

(86) PCT No.: PCT/JP2016/058862

§ 371 (c)(1),
(2) Date: Sep. 18, 2017

(87) PCT Pub. No.: WO2016/158533

PCT Pub. Date: Oct. 6, 2016

(65) Prior Publication Data

US 2018/0066542 A1 Mar. 8, 2018

(30) Foreign Application Priority Data

Mar. 30, 2015 (JP) ..... 2015-069505

(51) Int. Cl.
*F01D 25/28* (2006.01)

(52) U.S. Cl.
CPC ..... *F01D 25/28* (2013.01); *F05D 2230/60* (2013.01); *F05D 2230/70* (2013.01)

(58) Field of Classification Search
None
See application file for complete search history.

(56) References Cited

U.S. PATENT DOCUMENTS 7,887,291 B2 * 2/2011 Chevrette ..... F01D 25/246 415/209.2
8,834,113 B2 * 9/2014 Schaus ..... F01D 9/041 415/209.2

(Continued)

FOREIGN PATENT DOCUMENTS

EP 2 623 720 8/2013
JP 59-170404 9/1984

(Continued)

OTHER PUBLICATIONS

Office Action dated Nov. 25, 2019 in Indian Application No. 201747032312 with English translation.

*Primary Examiner* — Christopher Verdier
*Assistant Examiner* — Jason A Fountain
(74) *Attorney, Agent, or Firm* — Wenderoth, Lind & Ponack, L.L.P.

(57) ABSTRACT

A support device is provided with: a support member having a body disposed in a recess provided in the upper surface of the lower half of an outer member, and a protrusion provided on the body, the protrusion protruding toward the lower half of an inner member from a front surface facing the lower half of the inner member, the protrusion being disposed removably in a hole provided in the lower half of the inner member; a first adjustment member disposed between the bottom surface of the recess and the lower surface, facing the bottom surface, of the body; and an upper liner.

16 Claims, 15 Drawing Sheets

(56) References Cited

U.S. PATENT DOCUMENTS

| | | | | |
|---|---|---|---|---|
| 10,233,770 | B2 * | 3/2019 | Inagaki | F04D 17/122 |
| 2008/0286097 | A1 * | 11/2008 | Chevrette | F01D 25/246 415/209.2 |
| 2011/0116919 | A1 | 5/2011 | Burdgick et al. | |

FOREIGN PATENT DOCUMENTS

| | | |
|---|---|---|
| JP | 06-081604 | 3/1994 |
| JP | 2008-286195 | 11/2008 |
| JP | 2011-106452 | 6/2011 |
| JP | 2012-13046 | 1/2012 |

* cited by examiner

SUPPORT DEVICE, TURBINE, METHOD FOR ASSEMBLING ROTARY MACHINE, AND METHOD FOR DISASSEMBLING ROTARY MACHINE

TECHNICAL FIELD

The present invention relates to a support device, a turbine, a method for assembling a rotary machine, and a method for disassembling a rotary machine.

BACKGROUND ART

A blade ring of a turbine is supported by a support device provided at the lower half of a casing. The thickness of an adjustment member, such as a shim or liner, of the support device is adjusted to adjust the vertical position of the blade ring and thus to adjust a gap between a rotor and the blade ring. Patent Document 1 discloses a support device including a support attached to the lower half of a blade ring, a lower half liner supporting the support, and an upper half liner holding down the support. The vertical position of the blade ring is adjusted by adjusting the thickness of the lower half liner. The upper half liner holding down the support prevents the blade ring from being lifted up in releasing the casing.

CITATION LIST

Patent Document

Patent Document 1: Japanese Unexamined Patent Application Publication No. H06-081604A

SUMMARY OF INVENTION

Technical Problems

In the related art, in order to access the lower half liner to adjust the thickness of the lower half liner, it is required to release the upper halves of the casing and blade ring, remove the upper half liner, and then lift up the rotor and the lower half of the blade ring to such a height that the support can be detached from the lower half of the blade ring. In this case, it may take a long time to adjust the position of the blade ring.

An object of an aspect of the present invention is to provide a support device that enables smooth position adjustment of an inner member, such as a blade ring, a turbine, a method for assembling a rotary machine, and a method for disassembling a rotary machine.

Solution to Problem

A first aspect of the present invention provides a support device for a rotary machine including a stationary body disposed on a periphery of a rotating body rotating about a rotation axis, the stationary body including an outer member and an inner member capable of being divided vertically, the support device supporting the inner member on the outer member. The support device includes: a support member including a body disposed in a recess provided in an upper surface of a lower half of the outer member, and a protrusion provided on the body, the protrusion protruding toward a lower half of the inner member from a front surface facing the lower half of the inner member, and disposed removably in a hole provided in the lower half of the inner member; a first adjustment member disposed between a bottom surface of the recess and a lower surface, facing the bottom surface, of the body; and an upper liner including a horizontal section disposed above the body and facing an upper surface of the body with a first gap therebetween, and a vertical section disposed between an inner wall surface, facing inward in the radial direction with respect to the rotation axis, of the recess and a rear surface, facing the inner wall surface, of the body, the upper liner being affixed to the lower half of the outer member. A distance from the inner wall surface of the recess to an outer surface, located facing the inner wall surface, of the lower half of the inner member is greater than an outside dimension of the support member measured in a horizontal direction orthogonal to the rotation axis.

According to the first aspect of the present invention, in order to access the first adjustment member disposed between the bottom surface of the recess and the lower surface of the body of the support member, the support member can be taken out from the lower half of the inner member after the upper liner is removed from the recess, without lifting up a rotor and the inner member. Since the distance from the inner wall surface of the recess to the outer surface of the lower half of the inner member is greater than the outside dimension of the support member measured in the horizontal direction orthogonal to the rotation axis, the support member can be moved in the horizontal direction and the protrusion can be pulled out from the hole, and then the support member can be taken out from the lower half of the inner member without lifting up the rotor and the inner member. After the support member is taken out, the first adjustment member can be accessed. Since the first adjustment member can be accessed without lifting up the rotor and the inner member, the position of the inner member can be adjusted smoothly.

Since the distance from the inner wall surface of the recess to the outer surface of the lower half of the inner member is greater than the horizontal outside dimension of the support member, not only taking out of the support member from the recess after the protrusion is pulled out from the hole but also attachment of the support member can be performed smoothly.

The horizontal section of the upper liner disposed above the body of the support member prevents the inner member from being lifted up in releasing the outer member. If the upper half of the inner member is engaged with the upper half of the outer member because of thermal deformation or the like, the inner member may also be lifted up in disassembling the outer member and hoisting up the upper half of the outer member. However, since the horizontal section of the upper liner affixed to the lower half of the outer member is disposed above the body, the support member is prevented from being lifted up, and thus the inner member is prevented from being lifted up. The horizontal section also prevents the inner member from being lifted up during operation of the rotary machine. Although the inner member is a stationary body, when the rotating body rotates, the flow of a fluid applies force to the inner member, and the inner member attempts to move in the rotational direction. However, the horizontal section can suppress movement of the inner member through the support member. The vertical section of the upper liner disposed on the rear surface side of the body of the support member prevents the protrusion of the support member from falling out from the hole. If the support member is connected to the lower half of the inner member with a bolt, for example, even if the bolt is broken, the vertical section holds down the support member and the bolt and thus prevents the protrusion from falling off the hole.

The first gap prevents the horizontal section and the body from adhering to each other. Since the horizontal section and the vertical section are integrated with each other, the vertical position of the inner member can be adjusted with a small number of components and in a compact space.

In the first aspect of the present invention, the support device preferably further includes a second adjustment member adjusting a height of the horizontal section. The second adjustment member enables smooth adjustment of the height of the upper surface of the horizontal section with respect to the upper surface of the lower half of the outer member and smooth adjustment of the positional relationship between the support member and the upper liner in the height direction.

In the first aspect of the present invention, the second adjustment member may be disposed between the bottom surface of the recess and a lower surface, facing the bottom surface, of the vertical section. This configuration enables adjustment of the height of the upper liner. After the second adjustment member is arranged on the bottom surface, the upper liner is arranged on the second adjustment member. Thus, the assembly can be performed smoothly.

In the first aspect of the present invention, the first adjustment member and the second adjustment member may be formed as a single member. By forming the first adjustment member and the second adjustment member as a single member, the number of components can be reduced. If the adjustment members are a single member, the relative positions of the support member and the upper liner in the height direction can be maintained even when the adjustment members are replaced.

In the first aspect of the present invention, the upper liner may be divided into a first portion and a second portion disposed lower than at least part of the first portion, and the second adjustment member may be disposed between the first portion and the second portion. This configuration enables adjustment of the position of the upper surface of the horizontal section. When the positional relationship of the upper surface of the horizontal section with respect to the upper surface of the lower half of the outer member is adjusted, for example, the second adjustment member can be used for the adjustment without machining the upper surface of the horizontal section.

In the first aspect of the present invention, the upper liner preferably includes an upper surface disposed in the same plane as the upper surface of the lower half of the outer member or lower than the upper surface of the lower half of the outer member. This configuration allows the lower surface of the upper half of the outer member and the upper surface of the lower half of the outer member to come into close contact with each other. With the upper surface of the upper liner disposed in the same plane as the upper surface of the lower half of the outer member, when the horizontal section holds down the body to prevent the inner member from being lifted up during operation of the rotary machine, the upper surface of the upper liner is supported by the upper half of the outer member. Thus, when the horizontal section of the upper liner receives force, bending stress generated on the upper liner can be suppressed.

In the first aspect of the present invention, the support device may include a lower liner disposed between the body and the first adjustment member and coming into contact with the lower surface of the body. During operation of the rotary machine, thermal deformation or the like of the inner member may move the support member in the radial direction with respect to the rotation axis. If the first adjustment member is formed like a thin plate or a film, movement of the support member with the body of the support member and the first adjustment member being in contact with each other causes the first adjustment member to be rubbed and deteriorated. Furthermore, the bottom surface of the recess below the first adjustment member may be deteriorated. The lower liner disposed between the body and the first adjustment member and coming into contact with the lower surface of the body protects the first adjustment member and the bottom surface of the recess. This configuration suppresses deterioration of the first adjustment member and the bottom surface of the recess.

In the first aspect of the present invention, the vertical section preferably faces the rear surface of the body with a second gap therebetween. Both the first gap and second gap provide a space for the support member to move in the radial direction because of thermal deformation or the like of the inner member.

In the first aspect of the present invention, the upper liner may be affixed to the lower half of the outer member with a bolt penetrating the upper liner. This configuration enables smooth affixing of the upper liner to the lower half of the outer member.

In the first aspect of the present invention, the upper liner may include a bolt hole which penetrates the vertical section in a vertical direction and into which the bolt is inserted. This configuration enables smooth affixing of the upper liner to the lower half of the outer member.

A second aspect of the present invention provides a turbine including: the support device of the first aspect; the inner member; the outer member; and the rotating body.

According to the second aspect of the present invention, the position of the inner member can be adjusted smoothly with the support device of the first aspect.

A third aspect of the present invention provides a method for assembling a rotary machine including a stationary body disposed on a periphery of a rotating body rotating about a rotation axis, the stationary body including an outer member and an inner member capable of being divided vertically, the method assembling the rotary machine while the inner member is supported on the outer member. The method includes the steps of: arranging a first adjustment member on a bottom surface of a recess provided in an upper surface of a lower half of the outer member; inserting a support member into the recess, the support member including a body and a protrusion protruding toward a lower half of the inner member from a front surface of the body, inserting the protrusion into a hole provided in the lower half of the inner member, and arranging the body above the first adjustment member so that a distance from an inner wall surface, facing inward in the radial direction with respect to the rotation axis, of the recess to a rear surface, facing the inner wall surface, of the body is greater than a dimension of the protrusion measured in a horizontal direction orthogonal to the rotation axis; and inserting an upper liner into the recess, the upper liner including a horizontal section extending in the horizontal direction orthogonal to the rotation axis, and a vertical section extending in a vertical direction, arranging the horizontal section above the body so that the horizontal section faces an upper surface of the body with a first gap therebetween, arranging the vertical section between the inner wall surface of the recess and the rear surface of the body, and affixing the upper liner to the lower half of the outer member.

According to third aspect of the present invention, the support device can be assembled with the inner member disposed inside the lower half of the outer member, and the assembled support device can be used to adjust the position of the inner member. After the first adjustment member is arranged on the bottom surface of the recess, the support member is arranged in the recess. Thus, the height of the support member can be adjusted with the first adjustment member. Since the distance from the inner wall surface of the recess to the rear surface of the body is greater than the dimension of the protrusion in the horizontal direction orthogonal to the rotation axis with the protrusion inserted into the hole, the protrusion can be inserted into and taken out from the hole. After the support member is arranged, the upper liner is inserted into the recess. As such, the horizontal section is arranged above the body and the vertical section is arranged between the inner wall surface of the recess and the rear surface of the body. The horizontal section prevents the inner member from being lifted up in releasing the outer member and during operation of the rotary machine. The vertical section prevents the protrusion from falling off the hole.

In the third aspect of the present invention, the step of arranging the body above the first adjustment member may include arranging the protrusion at an opening of the hole and moving the support member in the horizontal direction orthogonal to the rotation axis. As such, the protrusion can be inserted into the hole only by moving the support member in the horizontal direction.

In the third aspect of the present invention, the method preferably further includes a step of adjusting a height of the horizontal section. As such, the height of the upper surface of the horizontal section can be adjusted with respect to the upper surface of the lower half of the outer member and the positional relationship between the support member and the upper liner can be adjusted in the height direction.

In the third aspect of the present invention, the step of adjusting the height of the horizontal section may include, after the upper liner is arranged in the recess, adjusting a height of an upper surface of the horizontal section with respect to the upper surface of the lower half of the outer member. As such, the height of the upper surface of the horizontal section can be appropriately adjusted with respect to the upper surface of the lower half of the outer member. For example, the upper surface of the horizontal section is machined so as to be positioned in the same plane as the upper surface of the lower half of the outer member or lower than the upper surface of the lower half of the outer member, and thus the upper surface of the lower half of the outer member and the lower surface of the upper half of the outer member can come into close contact with each other.

A fourth aspect of the present invention provides a method for disassembling a rotary machine including a stationary body disposed on a periphery of a rotating body rotating about a rotation axis, the stationary body including an outer member and an inner member capable of being divided vertically, and a support device supporting the inner member on the outer member. The support device includes: a support member including a body disposed in a recess provided in an upper surface of a lower half of the outer member, and a protrusion protruding toward a lower half of the inner member from a front surface of the body, the protrusion being disposed removably in a hole provided in the lower half of the inner member; a first adjustment member disposed between a bottom surface of the recess and a lower surface, facing the bottom surface, of the body and adjusting a height of the support member; and an upper liner including a horizontal section disposed above the body and facing an upper surface of the body with a first gap therebetween, and a vertical section disposed between an inner wall surface, facing inward in the radial direction with respect to the rotation axis, of the recess and a rear surface, facing the inner wall surface, of the body, the upper liner being affixed to the lower half of the outer member. The method includes the steps of: removing the upper liner from the recess; moving the support member in a horizontal direction orthogonal to the rotation axis so that the rear surface approaches the inner wall surface, and taking out the protrusion from the hole; and after the protrusion is taken out from the hole, removing the support member from the recess.

According to the fourth aspect of the present invention, it is possible to take out the upper liner, take out the support member from the lower half of the inner member, and access the first adjustment member to adjust the first adjustment member, without lifting up the rotor and the inner member. Thus, the position of the inner member can be adjusted smoothly with the support device.

Advantageous Effects of Invention

The aspects of the present invention provide the support device that enables smooth position adjustment of the inner member, the turbine, the method for assembling a rotary machine, and the method for disassembling a rotary machine.

DESCRIPTION OF EMBODIMENTS

Embodiments according to the present invention will be described below with reference to the accompanying drawings. However, the present invention is not limited to these embodiments. The constituent elements of the embodiments described below can be combined with each other as desired. Furthermore, some constituent elements may not be used in some cases.

In the following description, an XYZ Cartesian coordinate system is set, and positional relationships of the constituents are described while referencing this XYZ Cartesian coordinate system. Herein, a direction in a horizontal plane is defined as an "X-axis direction", a direction orthogonal to the X-axis direction in the horizontal plane is defined as a "Y-axis direction", and a vertical direction orthogonal to both the X-axis direction and the Y-axis direction is defined as a "Z-axis direction". The XY plane is parallel to the horizontal plane. A position in the Z-axis direction indicates a height.

First Embodiment

Figure 1:
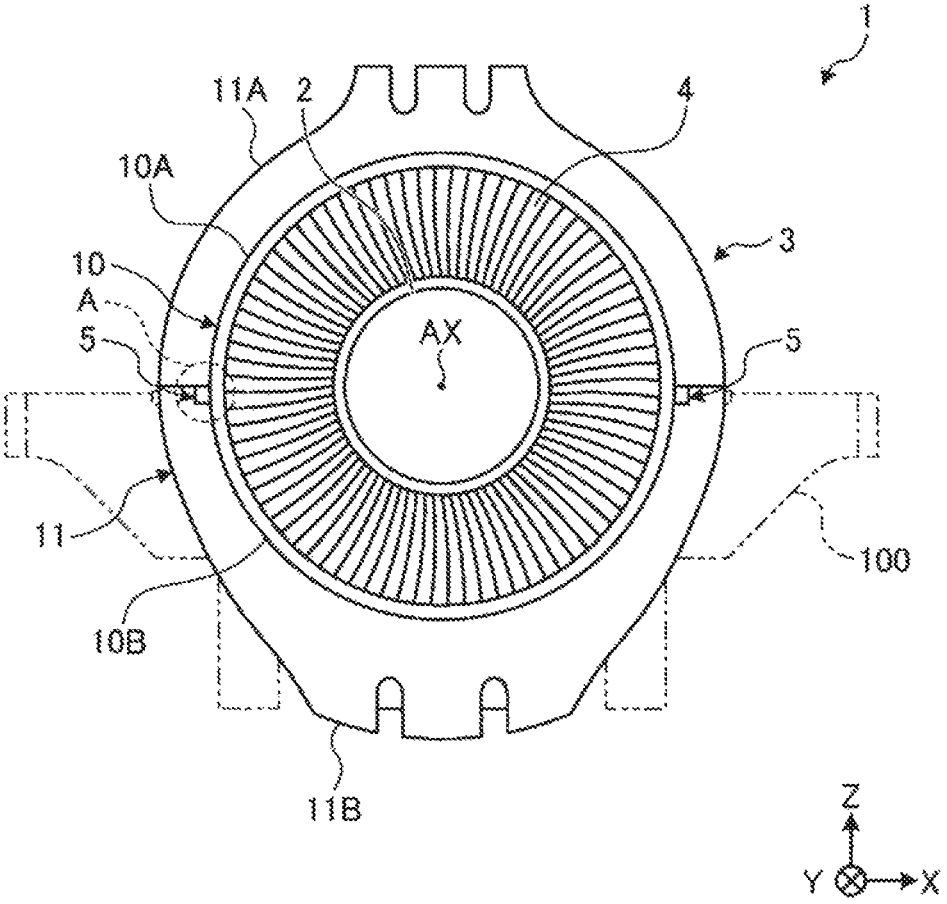
FIG. 1 is a cross-sectional view illustrating a steam turbine according to a first embodiment.

FIG. 1 is a cross-sectional view illustrating a steam turbine 1 being a type of rotary machine. As illustrated in FIG. 1, the steam turbine 1 includes a rotating body 2 that rotates about a rotation axis AX and a stationary body 3 that is disposed on the periphery of the rotating body 2 and can be divided vertically. The rotating body 2 includes blades and a rotor supporting the blades. The rotation axis AX is parallel to the Y-axis. In the following description, "radial direction" refers to a direction orthogonal to the rotation axis AX, "inward in the radial direction" refers to a side that is near to the rotation axis AX, and "outward in the radial direction" refers to a side that is far from the rotation axis AX.

The stationary body 3 includes a blade ring 10 supporting vanes 4 and a casing 11 disposed on the periphery of the blade ring 10. The casing 11 is supported by a frame 100 and houses the rotor 2 and blade ring 10. The blade ring 10 is an inner member disposed on the periphery of the rotating body 2. The casing 11 is an outer member disposed outside the blade ring 10 with respect to the rotation axis AX.

The blade ring 10 is divided into an upper half 10A and a lower half 10B, and the casing 11 is divided into an upper half 11A and a lower half 11B. The upper half 10A is an upper half of the inner member, and the lower half 10B is a lower half of the inner member. The upper half 11A is an upper half of the outer member, and the lower half 11B is a lower half of the outer member.

The steam turbine 1 includes support devices 5 provided at the casing 11 and supporting the blade ring 10. The support devices 5 support the blade ring 10 on the casing 11 and can adjust the height of the blade ring 10. The dimension of a gap between the rotor 2 and the blade ring 10 is adjusted by adjusting the height of the blade ring 10 with the support devices 5.

Figure 2:
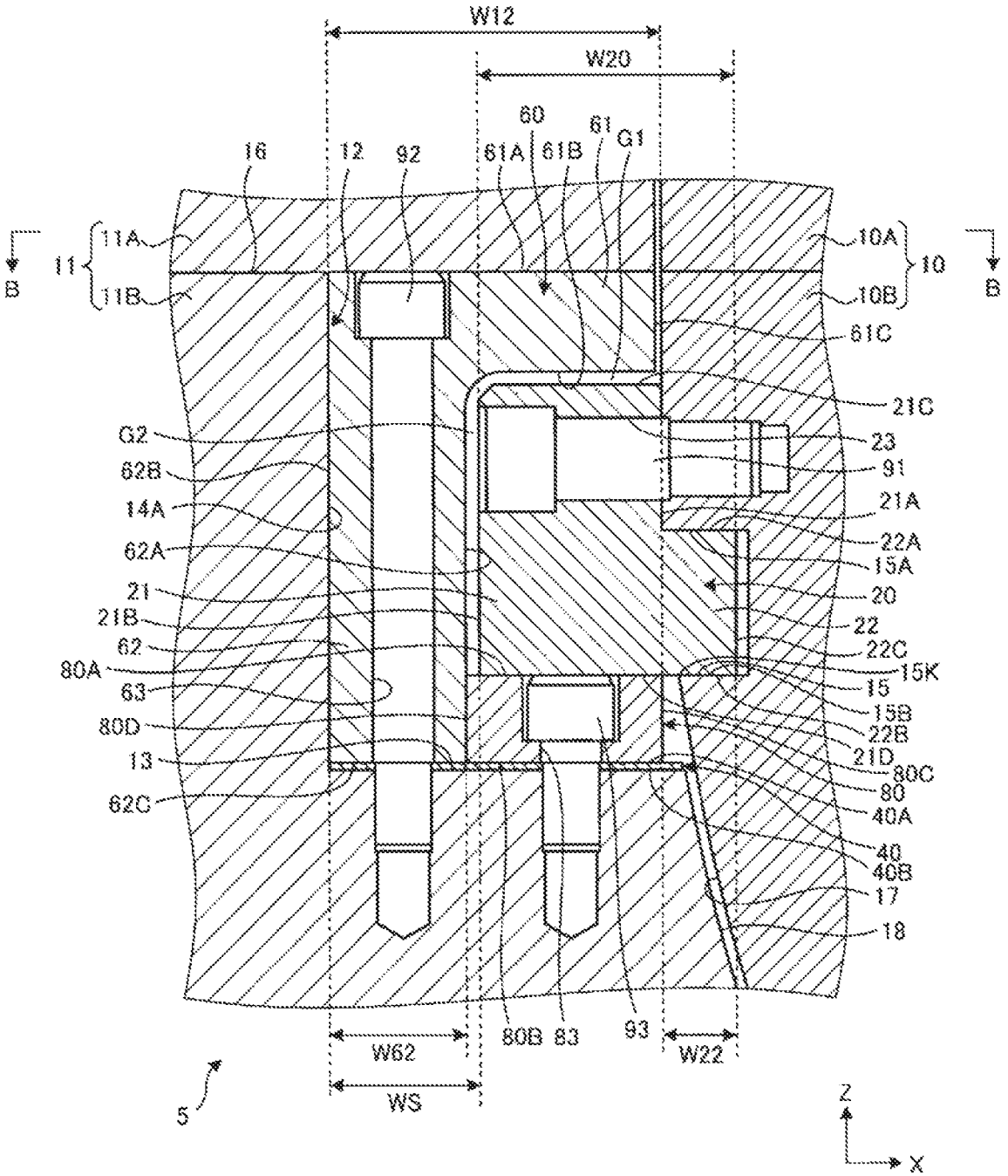
FIG. 2 is a cross-sectional view illustrating a support device according to the first embodiment.
Figure 3:
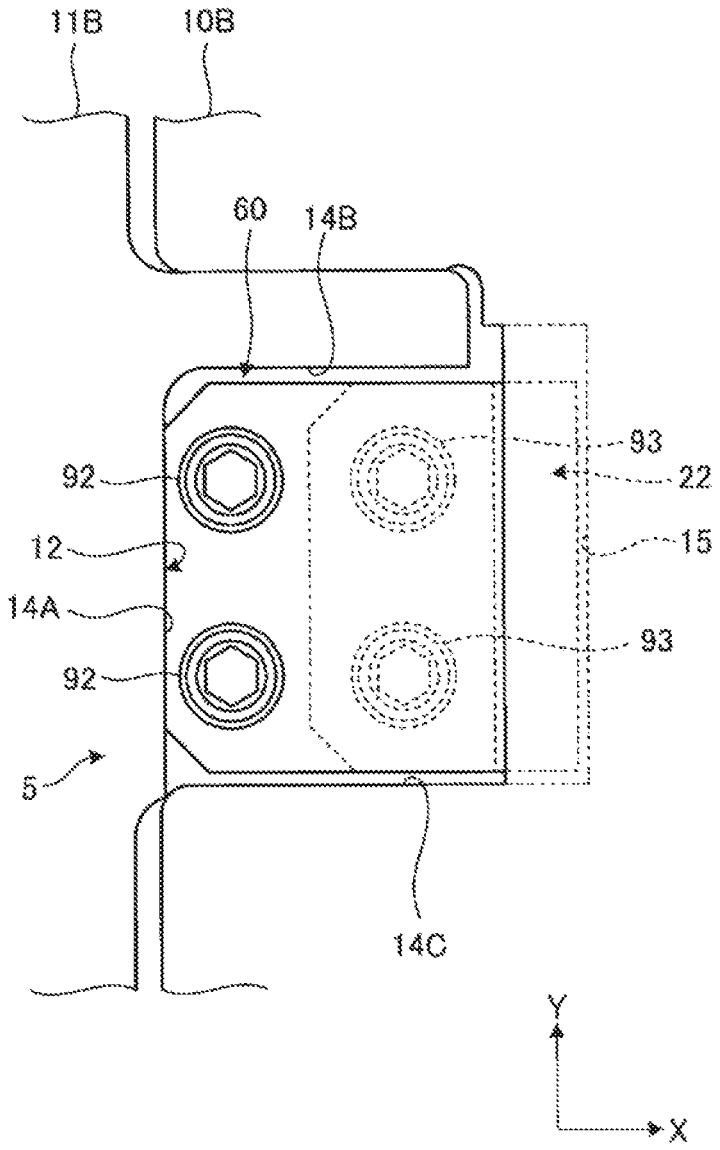
FIG. 3 is a view taken along the line B-B in FIG. 2.

FIG. 2 is a cross-sectional view illustrating the support device 5 and a portion A in FIG. 1. FIG. 3 is a view taken along the line B-B in FIG. 2. As illustrated in FIGS. 2 and 3, the support device 5 includes a support member 20 supporting the blade ring 10, an adjusting shim 40 being a first adjustment member adjusting the height of the support member 20, an upper liner 60 affixed to the lower half 11B, and a lower liner 80 disposed between the support member 20 and the adjusting shim 40.

The lower half 11B has an upper surface 16 joined to a lower surface of the upper half 11A and an inner surface 18 facing an outer surface 17 of the lower half 10B. A recess 12 is provided in the upper surface 16 of the lower half 11B. The recess 12 is formed by partially cutting off the upper surface 16 and inner surface 18.

The recess 12 has a bottom surface 13 that faces the +Z direction and is parallel to the XY plane, an inner wall surface 14A that faces the +X direction being inward in the radial direction with respect to the rotation axis AX and is parallel to the YZ plane, an inner wall surface 14B that faces the −Y direction and is parallel to the XZ plane, and an inner wall surface 14C that faces the +Y direction and is parallel to the XZ plane.

A hole 15 extending in the horizontal direction is provided in the lower half 10B. The hole 15 has an opening 15K formed in the outer surface 17 of the lower half 10B. The hole 15 has an inner wall surface 15A that faces the −Z direction and is parallel to the XY plane and an inner wall surface 15B that faces the +Z direction and is parallel to the XY plane.

The support member 20 includes a body 21 that is disposed in the recess 12 and a protrusion 22 that is provided on the body 21, protrudes from a front surface 21A, facing the lower half 10B, of the body 21 toward the lower half 10B, and is removably disposed in the hole 15 of the lower half 10B.

The body 21 has the front surface 21A that faces the +X direction being inward in the radial direction with respect to the rotation axis AX and is parallel to the YZ plane, a rear surface 21B that faces the −X direction being outward in the radial direction with respect to the rotation axis AX and is parallel to the YZ plane, an upper surface 21C that faces the +Z direction and is parallel to the XY plane, and a lower surface 21D that faces the −Z direction and is parallel to the XY plane.

The front surface 21A of the body 21 faces the outer surface 17 of the lower half 10B. The rear surface 21B of the body 21 faces a front surface 62A of a vertical section 62 of the upper liner 60 and can face the inner wall surface 14A of the recess 12. The upper surface 21C of the body 21 faces a lower surface 61B of a horizontal section 61 of the upper liner 60. The lower surface 21D of the body 21 faces an upper surface 80A of the lower liner 80 and can face the bottom surface 13 of the recess 12.

The protrusion 22 protrudes from the front surface 21A in the +X direction. The protrusion 22 has an upper surface 22A that is parallel to the XY plane and faces the inner wall surface 15A, a lower surface 22B that is parallel to the XY plane and faces the inner wall surface 15B, and a front surface 22C that faces the +X direction and is parallel to the YZ plane. The lower surface 21D and the lower surface 22B are disposed in the same plane.

The adjusting shim 40 is disposed between the bottom surface 13 of the recess 12 and the lower surface 21D, facing the bottom surface 13, of the body 21 and adjusts the height of the support member 20. The adjusting shim 40 is a thin plate or film-like member. The adjusting shim 40 has an upper surface 40A facing the +Z direction and a lower surface 40B facing the −Z direction and coming into contact with the bottom surface 13.

The upper surface 40A of the adjusting shim 40 faces a lower surface 80B of the lower liner 80 and a lower surface 62C of the upper liner 60 and can face the lower surface 21D of the body 21. The lower surface 40B of the adjusting shim 40 faces the bottom surface 13 of the recess 12.

The upper liner 60 includes the horizontal section 61 that is disposed above the body 21 and faces the upper surface 21C of the body 21 with a first gap G1 therebetween, and the vertical section 62 that is disposed between the inner wall surface 14A of the recess 12 and the rear surface 21B of the body 21. The support member 20 and the upper liner 60 are apart from each other.

The horizontal section 61 extends in the horizontal direction orthogonal to the rotation axis AX. The horizontal section 61 has an upper surface 61A that faces the +Z direction and is parallel to the XY plane, the lower surface 61B that faces the −Z direction and is parallel to the XY plane, and a front surface 61C that faces the +X direction and is parallel to the YZ plane, The lower surface 61B of the horizontal section 61 and the upper surface 21C of the body 21 face each other with the first gap G1 therebetween. The upper surface 61A of the horizontal section 61 is arranged in the same plane as the upper surface 16 of the lower half 11B or lower than the upper surface 16 of the lower half 11B.

The vertical section 62 extends in the vertical direction. The vertical section 62 has the front surface 62A that faces the +X direction and is parallel to the YZ, plane, a rear surface 62B that faces the −X direction and is parallel to the YZ plane, and the lower surface 62C that faces the −Z direction and is parallel to the XY plane. The front surface 62A of the vertical section 62 and the rear surface 21B of the body 21 face each other with a second gap G2 therebetween. The rear surface 62B of the vertical section 62 and the inner wall surface 14A of the recess 12 come into contact with each other.

The adjusting shim 40 is disposed between the bottom surface 13 and the body 21 and between the bottom surface 13 and the vertical section 62. The adjusting shim 40 adjusts the height of the support member 20 and the height of the horizontal section 61 of the upper liner 60. The lower surface 62C of the vertical section 62 and the upper surface 40A of the adjusting shim 40 come into contact with each other.

The lower liner 80 is disposed between the body 21 and the adjusting shim 40 and has the upper surface 80A that comes into contact with the lower surface 21D of the body 21, the lower surface 80B that comes into contact with the upper surface 40A of the adjusting shim 40, a front surface 80C that faces the +X direction and is parallel to the YZ, plane, and a rear surface 80D that faces the −X direction and is parallel to the YZ, plane.

The distance from the upper surface 80A to the lower surface 80B, which defines the thickness of the lower liner 80, is greater than the distance from the upper surface 40A to the lower surface 40B, which defines the thickness of the adjusting shim 40. The lower liner 80 is a block-like member.

The support member 20 is affixed to the lower half 10B with a bolt 91 penetrating the body 21. The support member 20 includes a bolt hole 23 that penetrates the body 21 in the horizontal direction and into which the bolt 91 is inserted. The bolt hole 23 penetrates the front surface 21A and the rear surface 21B.

The upper liner 60 is affixed to the lower half 11B with a bolt 92 penetrating the upper liner 60. The upper liner 60 includes a bolt hole 63 that penetrates the vertical section 62 in the vertical direction and into which the bolt 92 is inserted. The bolt hole 63 penetrates the upper surface 61A and the lower surface 62C.

The lower liner 80 is affixed to the lower half 11B with a bolt 93 penetrating the lower liner 80. The lower liner 80 includes a bolt hole 83 that penetrates in the vertical direction and into which the bolt 93 is inserted. The bolt hole 83 penetrates the upper surface 80A and the lower surface 80B.

The dimension W62 of the vertical section 62 in the horizontal direction (X-axis direction) is greater than the dimension W22 of the protrusion 22 in the horizontal direction (X-axis direction). The dimension W62 includes the distance from the front surface 62A to the rear surface 62B. The dimension W22 is the distance from the interface between the front surface 21A and the upper surface 22A to the interface between the upper surface 22A and the front surface 22C. In other words, the dimension W22 of the protrusion 22 is the distance over which the inner wall surface 15A of the hole 15 and the protrusion 22 overlap each other in the horizontal direction.

A region, facing the front surface 21A of the body 21 and the front surface 61C of the horizontal section 61, of the outer surface 17 of the lower half 10B is a plane parallel to the YZ plane. The distance W12 from the inner wall surface 14A of the recess 12 to the outer surface 17, located facing the inner wall surface 14A, of the lower half 10B is greater than the dimension W20 being the outside dimension of the support member 20 measured in the horizontal direction orthogonal to the rotation axis AX. The dimension W20 is the distance from the rear surface 21B to the front surface 22C in the horizontal direction (X-axis direction).

When the protrusion 22 is inserted into the hole 15, the distance WS from the inner wall surface 14A, facing inward in the radial direction with respect to the rotation axis AX, of the recess 12 to the rear surface 21B, facing the inner wall surface 14A, of the body 21 is greater than the dimension W22 of the protrusion 22 measured in the horizontal direction orthogonal to the rotation axis AX.

When the protrusion 22 of the support member 20 is inserted into the hole 15 and the upper surface 22A comes into contact with the inner wall surface 15A, the lower half 10B of the blade ring 10 is supported by the support member 20. The height of the lower half 10B with respect to the lower half 11B is adjusted by adjusting the height of the support member 20 with respect to the bottom surface 13. The height of the support member 20 is adjusted by adjusting the thickness of the adjusting shim 40. The height of the support member 20 is adjusted by replacing the adjusting shim 40.

Figure 4:
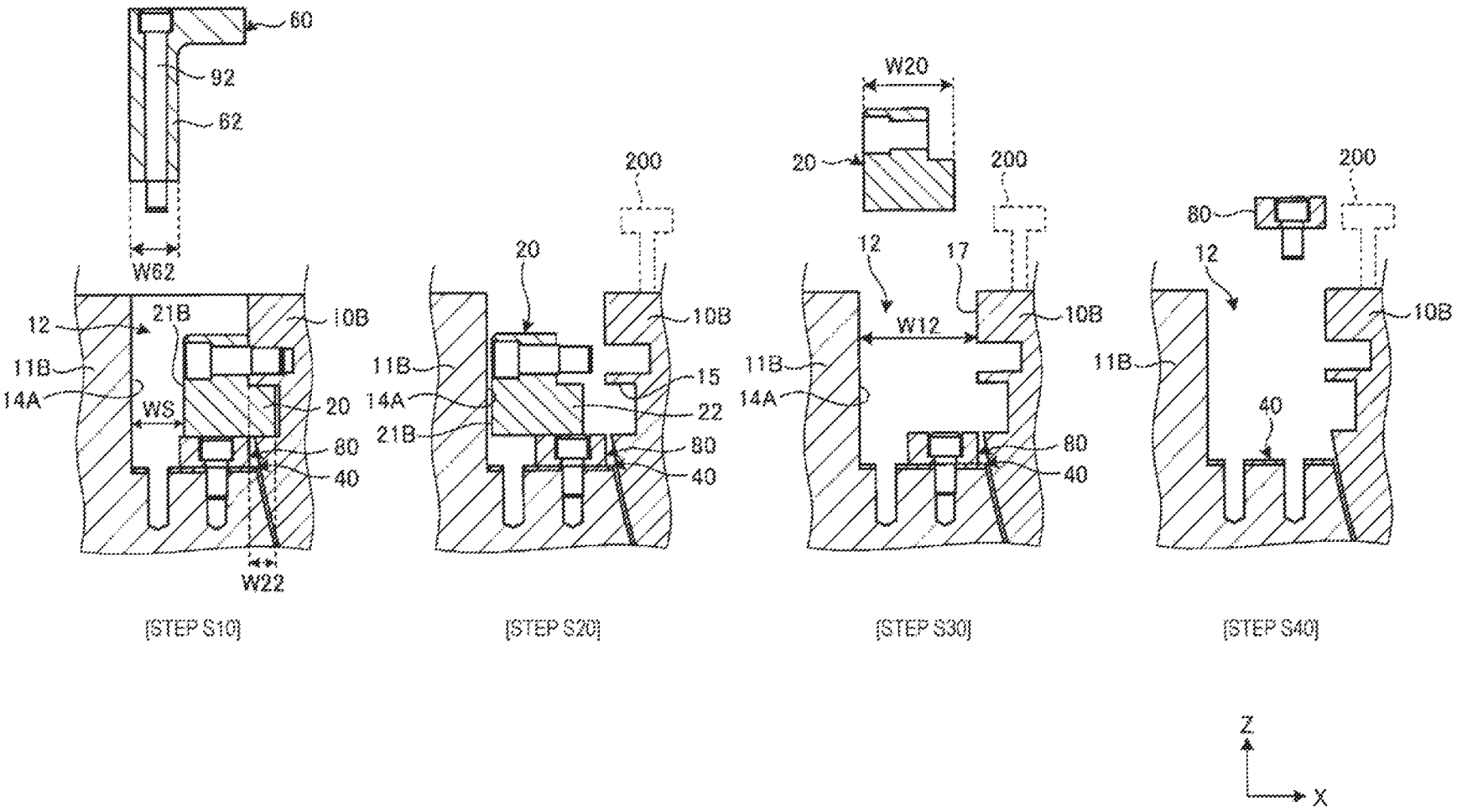
FIG. 4 is a schematic view illustrating a method for disassembling a steam turbine according to the first embodiment.

A method for disassembling the steam turbine 1 will now be described. FIG. 4 is a schematic view illustrating the method for disassembling the steam turbine 1. The upper half 11A is separated from the lower half 11B, and then the upper liner 60 is detached from the lower half 11B. The bolt 92, which is disposed in the bolt hole 63 penetrating the upper surface 61A and the lower surface 62C of the upper liner 60, is unfastened to detach the upper liner 60 from the lower half 11B. After the upper liner 60 is detached from the lower half 11B, the upper liner 60 is removed from the recess 12 (step S10). The dimension (distance) WS from the inner wall surface 14A to the rear surface 21B with the upper liner 60 removed is greater than the dimension W62. The dimension WS is greater than the dimension W22.

Next, the support member 20 is moved in the horizontal direction (−X direction) orthogonal to the rotation axis AX so that the rear surface 21B approaches the inner wall surface 14A. As such, the protrusion 22 can be taken out from the hole 15 (step S20). The dimension W22 is smaller than the dimension W62 and the dimension WS. Thus, moving the support member 20 in the −X direction allows the protrusion 22 to be pulled out from the hole 15.

In pulling out the protrusion 22 from the hole 15, the lower half 10B is supported by a support mechanism 200, such as a crane or an affixing mechanism that affixes the lower half 10B with respect to the lower half 11B. The support mechanism 200 supports the lower half 10B to prevent the weight of the lower half 10B from being put on the lower half 11B through the support member 20. This configuration enables the protrusion 22 to be readily pulled out from the hole 15. Furthermore, the support mechanism 200 supporting the lower half 10B prevents the lower half 10B from falling after the protrusion 22 is pulled out from the hole 15.

After the protrusion 22 is taken out from the hole 15, the support member 20 is removed from the recess 12 (step S30). The distance W12 between the inner wall surface 14A and the outer surface 17 is greater than the horizontal dimension W20 of the support member 20. This configuration allows the support member 20 to be taken out from the recess 12 after the protrusion 22 is pulled out from the hole 15.

After the support member 20 is removed from the recess 12, the lower liner 80 is removed (step S40). As such, the adjusting shim 40 disposed below the support member 20 and the lower liner 80 can be accessed. The thickness of the adjusting shim 40 is adjusted to adjust the height of the support member 20. In the present embodiment, the adjusting shim 40 disposed in the recess 12 is replaced with an adjusting shim 40 having a different thickness to adjust the height of the support member 20.

Figure 5:
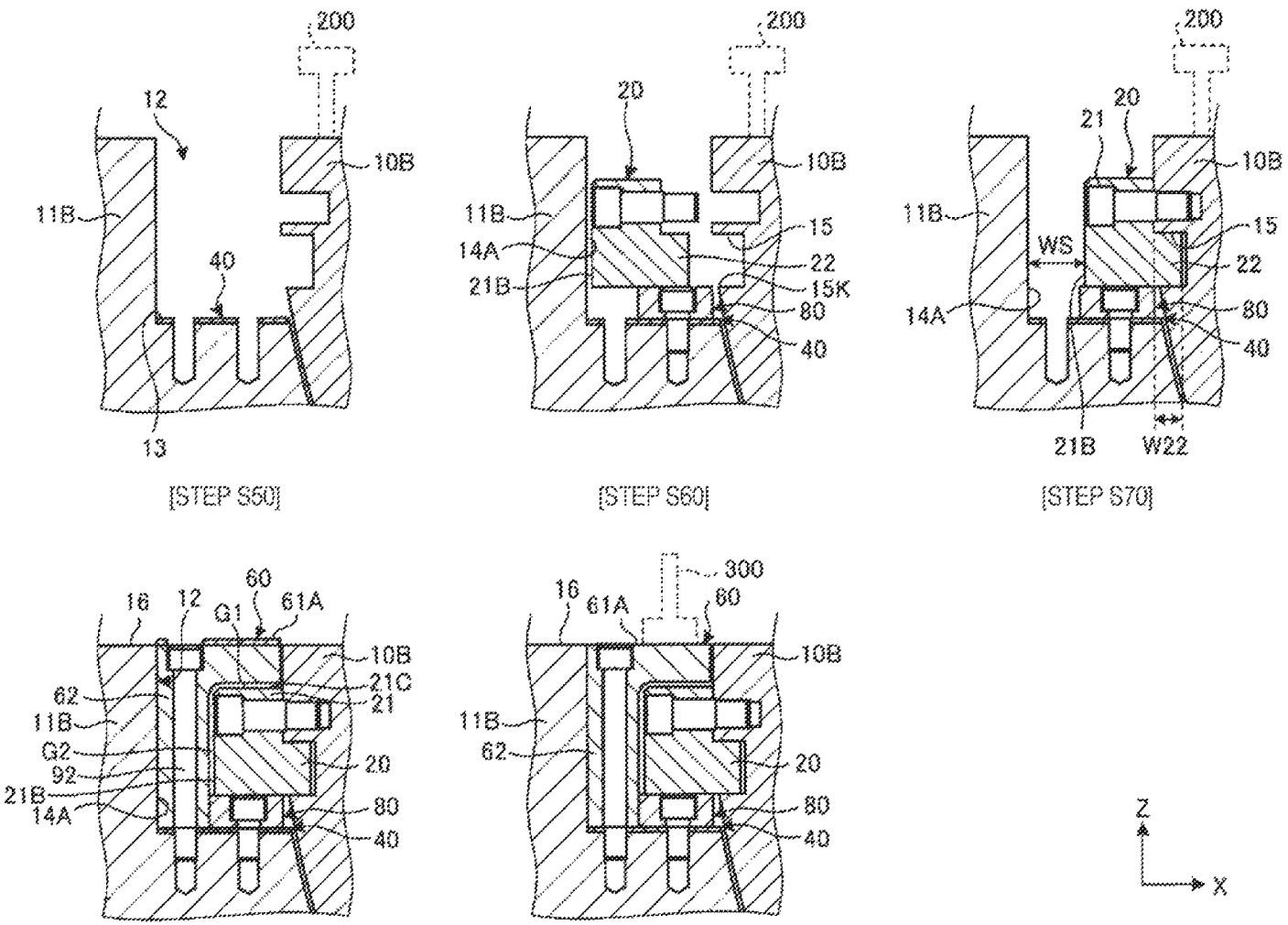
FIG. 5 is a schematic view illustrating a method for assembling the steam turbine according to the first embodiment.

A method for assembling the steam turbine 1 will now be described. FIG. 5 is a schematic view illustrating the method for assembling the steam turbine 1. The adjusting shim 40 is arranged on the bottom surface 13 of the recess 12 (step S50).

The lower liner 80 is disposed, and then the support member 20 including the body 21 and the protrusion 22 is inserted into the recess 12. The protrusion 22 of the support member 20 inserted into the recess 12 is arranged at the opening 15K of the hole 15 (step S60). The distance W12 from the inner wall surface 14A of the recess 12 to the outer surface 17 of the lower half 10B is greater than the dimension W20 of the support member 20, and thus the support member 20 is smoothly inserted into the recess 12.

After the protrusion 22 is arranged at the opening 15K of the hole 15, the support member 20 is moved in the horizontal direction (+X direction) orthogonal to the rotation axis AX. This movement allows the protrusion 22 to be inserted into the hole 15 and the body 21 to be arranged above the adjusting shim 40 and the lower liner 80 (step 570).

When the protrusion 22 is inserted into the hole 15 and the body 21 is arranged above the adjusting shim 40, a space is defined that has the dimension (distance) WS, greater than the horizontal dimension W22 of the protrusion 22, between the inner wall surface 14A of the recess 12 and the rear surface 21B of the body 21. The body 21 is arranged above the adjusting shim 40 so that the distance WS from the inner wall surface 14A of the recess 12 to the rear surface 21B of the body 21 is greater than the dimension W22 of the protrusion 22 measured in the horizontal direction orthogonal to the rotation axis AX.

Next, the upper liner 60 is inserted into the recess 12. The horizontal section 61 is arranged above the body 21 so as to face the upper surface 21C of the body 21 with the first gap G1 therebetween. The vertical section 62 is arranged between the inner wall surface 14A of the recess 12 and the rear surface 21B of the body 21. After the upper liner 60 is arranged in the recess 12, the upper liner 60 is affixed to the lower half 11B (step S80), The upper liner 60 is affixed to the lower half 11B with the bolt 92 disposed in the bolt hole 63.

After the upper liner 60 is arranged in the recess 12 and affixed to the lower half 11B, the height of the upper surface 61A of the horizontal section 61 is adjusted with respect to the upper surface 16 of the lower half 11B (step S90). Since the adjusting shim 40 is replaced, the upper surface 61A of the horizontal section 61 may be arranged higher than the upper surface 16 of the lower half 11B. The upper surface 61A of the horizontal section 61 is subjected to cutting with a machining tool 300 so that the upper surface 61A of the horizontal section 61 is arranged in the same plane as the upper surface 16 of the lower half 11B or lower than the upper surface 16 of the lower half 11B.

Thereafter the upper half 11A is joined to the lower half 11B. Since the upper surface 61A of the horizontal section 61 is arranged in the same plane as the upper surface 16 of the lower half 11B or lower than the upper surface 16, the upper surface 16 of the lower half 11B can come into close contact with the lower surface of the upper half 11A.

As described above, according to the present embodiment, the distance W12 between the inner wall surface 14A of the recess 12 and the outer surface 17 of the lower half 10B is greater than the dimension W20 being the outside dimension of the support member 20. Thus, in order to access the adjusting shim 40 to adjust the height of the support member 20, the support member 20 can be taken out from the lower half 10B after the upper liner 60 is removed from the recess 12, without lifting up the rotor 2 and the lower half 10B to such a position that the opening 15K of the hole 15 is positioned higher than the upper surface 16 of the lower half 11B. In disassembling the steam turbine 1, when the upper liner 60 is removed from the recess 12, the space having the dimension WS greater than the dimension W22 is defined on the rear surface 21B side of the support member 20. Thus, even without lifting up the rotor 2 and the blade ring 10 to such a position that the opening 15K is positioned higher than the upper surface 16, the support member 20 can be taken out from the lower half 10B by moving the support member 20 in the horizontal direction to pull out the protrusion 22 from the hole 15, while maintaining the relative positions of the lower half 11B and the lower half 10B in the height direction. After the support member 20 is taken out, the adjusting shim 40 can be accessed to replace the adjusting shim 40. Accordingly, the position of the blade ring 10 can be adjusted smoothly.

The horizontal section 61 disposed above the body 21 prevents the blade ring 10 from being lifted up in releasing the casing 11. If the upper half 10A is engaged with the upper half 11A because of thermal deformation or the like, the blade ring 10 may also be lifted up in disassembling the casing 11 and hoisting up the upper half 11A. Since the horizontal section 61 of the upper liner 60 affixed to the lower half 11B is disposed above the body 21 of the support member 20, the horizontal section 61 holds down the support member 20 and thus prevents the blade ring 10 from being lifted up.

The horizontal section 61 disposed above the body 21 prevents the blade ring 10 from being lifted up during operation of the steam turbine 1. When the rotor 2 rotates, the flow of a fluid applies force to the blade ring 10, and the blade ring 10 attempts to move in the rotational direction. Since the horizontal section 61 is provided, the horizontal section 61 holds down the support member 20 and thus prevents the blade ring 10 from being lifted up even if the blade ring 10 attempts to move in the rotational direction.

The vertical section 62 disposed on the rear surface 21B side of the body 21 prevents the protrusion 22 of the support member 20 from falling out from the hole 15. Even if the bolt 91 is broken, the vertical section 62 suppresses movement, outward in the radial direction with respect to the rotation axis AX, of the support member 20 and thus prevents the protrusion 22 from falling off the hole 15.

Since the upper liner 60 is a single member in which the horizontal section 61 and the vertical section 62 are integrated with each other, the height of the blade ring 10 can be adjusted with a small number of components and in a compact space.

The first gap G1 prevents the horizontal section 61 and the body 21 from adhering to each other. During operation of the steam turbine 1, thermal deformation or the like of the blade ring 10 may move the support member 20 in the radial direction. The first gap G1 and second gap G2 provide a space for the support member 20 to move.

Since the height of the horizontal section 61 is adjusted with the adjusting shim 40, the height of the upper surface 61A of the horizontal section 61 with respect to the upper surface 16 of the lower half 11B and the positional relationship between the support member 20 and the upper liner 60 in the height direction can be adjusted smoothly. The adjusting shim 40 is disposed between the bottom surface 13 of the recess 12 and the lower surface 62C of the vertical section 62. Thus, by disposing the adjusting shim 40 on the bottom surface 13 and then disposing the upper liner 60 above the adjusting shim 40, the first gap G1 can be maintained optimally and constantly. Furthermore, the assembly can be performed smoothly with a small number of components. Since the number of components is small, the disassembly can also be performed smoothly.

Both the height of the support member 20 and the height of the upper liner 60 are adjusted with the adjusting shim 40 being a single member. Thus, even if the thickness of the adjusting shim 40 varies, the relative positions of the support member 20 and the upper liner 60 in the height direction are constant, and the first gap G1 can thus be kept constant. Since the number of components is small, the assembly and disassembly can be performed smoothly.

The lower liner 80 disposed between the body 21 and the adjusting shim 40 protects the adjusting shim 40 even if thermal deformation or the like of the blade ring 10 moves the support member 20 in the radial direction. The adjusting shim 40 is formed like a thin plate or film. Thus, if the support member 20 and the adjusting shim 40 are in contact with each other, it is highly likely that movement of the support member 20 in the radial direction damages the adjusting shim 40. Furthermore, such damage to the adjusting shim 40 may also damage the bottom surface 13. The lower liner 80 prevents such damage to the adjusting shim 40. The lower liner 80 is formed like a block and is thicker than the adjusting shim 40. Thus, even if rubbed against the support member 20, the lower liner 80 is less likely to be damaged than the adjusting shim 40. The lower liner 80 is replaceable. Thus, if the lower liner 80 is deteriorated because of friction with the support member 20, the lower liner 80 can be replaced.

Second Embodiment

A second embodiment of the present invention will be described below. In the following descriptions, the same reference signs will be assigned to the same or substantially the same constituent elements as in the above-described embodiment, and descriptions thereof will be simplified or omitted.

Figure 6:
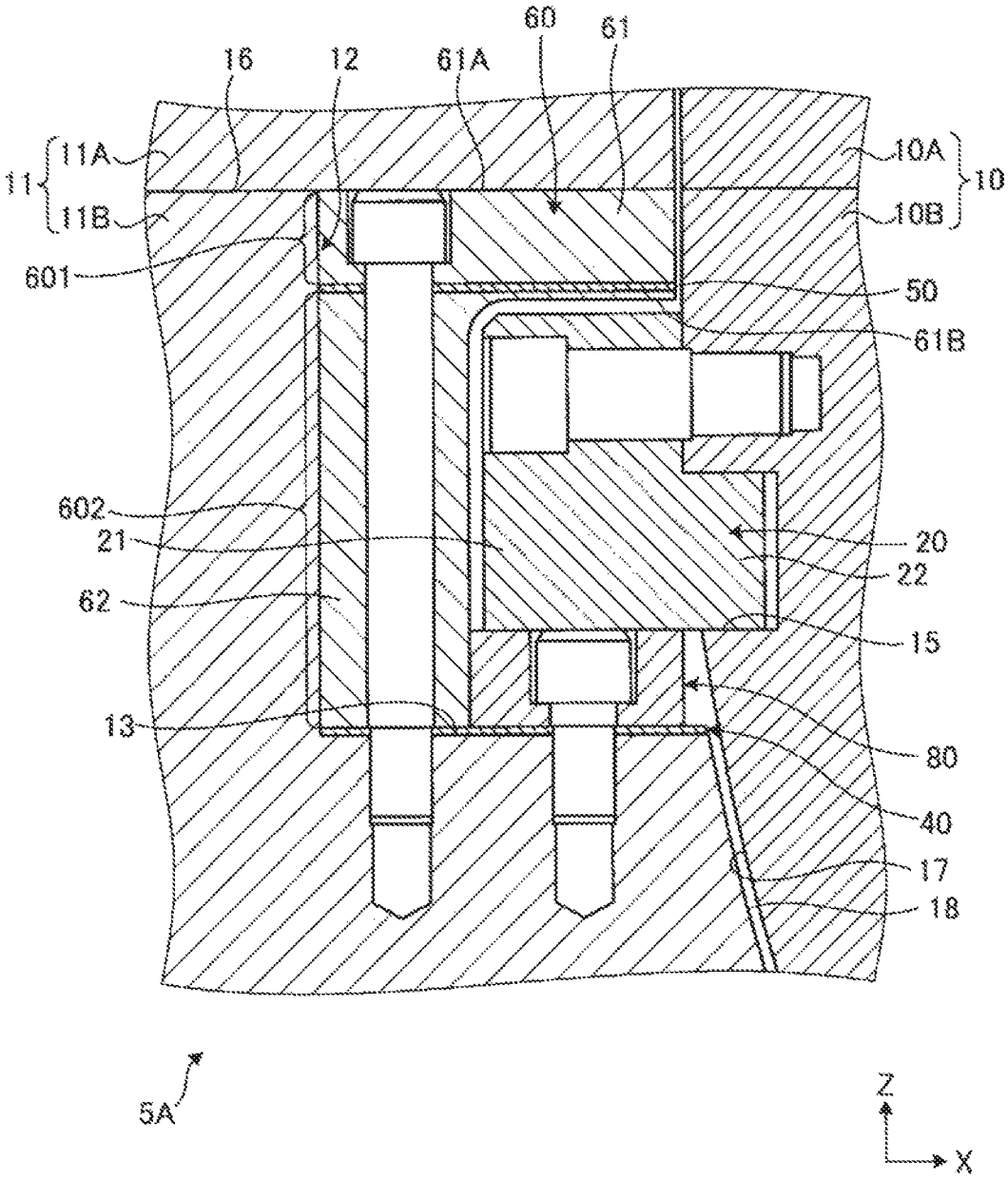
FIG. 6 is a cross-sectional view illustrating a support device according to a second embodiment.

FIG. 6 is a cross-sectional view illustrating a support device 5A according to the present embodiment. As illustrated in FIG. 6, the upper liner 60 is divided into a first portion 601 having the upper surface 61A of the horizontal section 61 and a second portion 602 disposed lower than at least part of the first portion 601. In the present embodiment, the horizontal section 61 is divided into the first portion 601 and the second portion 602, and the entire second portion 602 is disposed below the first portion 601. The first portion 601 includes part of the horizontal section 61. The second portion 602 includes part of the horizontal section 61 and the vertical section 62.

An adjusting shim 50 being a second adjustment member adjusting the height of the upper surface 61A of the horizontal section 61 is disposed between the first portion 601 and the second portion 602. The adjusting shim 50 adjusts the height of the horizontal section 61 but does not adjust the height of the support member 20. The adjusting shim 40 adjusting the height of the support member 20 and the adjusting shim 50 adjusting the height of the upper surface 61A of the horizontal section 61 are provided separately. Thus, adjustment (replacement) of the adjusting shim 50 eliminates the need for cutting to adjust the height of the upper surface 61A of the horizontal section 61 with respect to the upper surface 16 of the lower half 11B. In addition, the first gap G1 can be maintained optimally and constantly.

Third Embodiment

Figure 7:
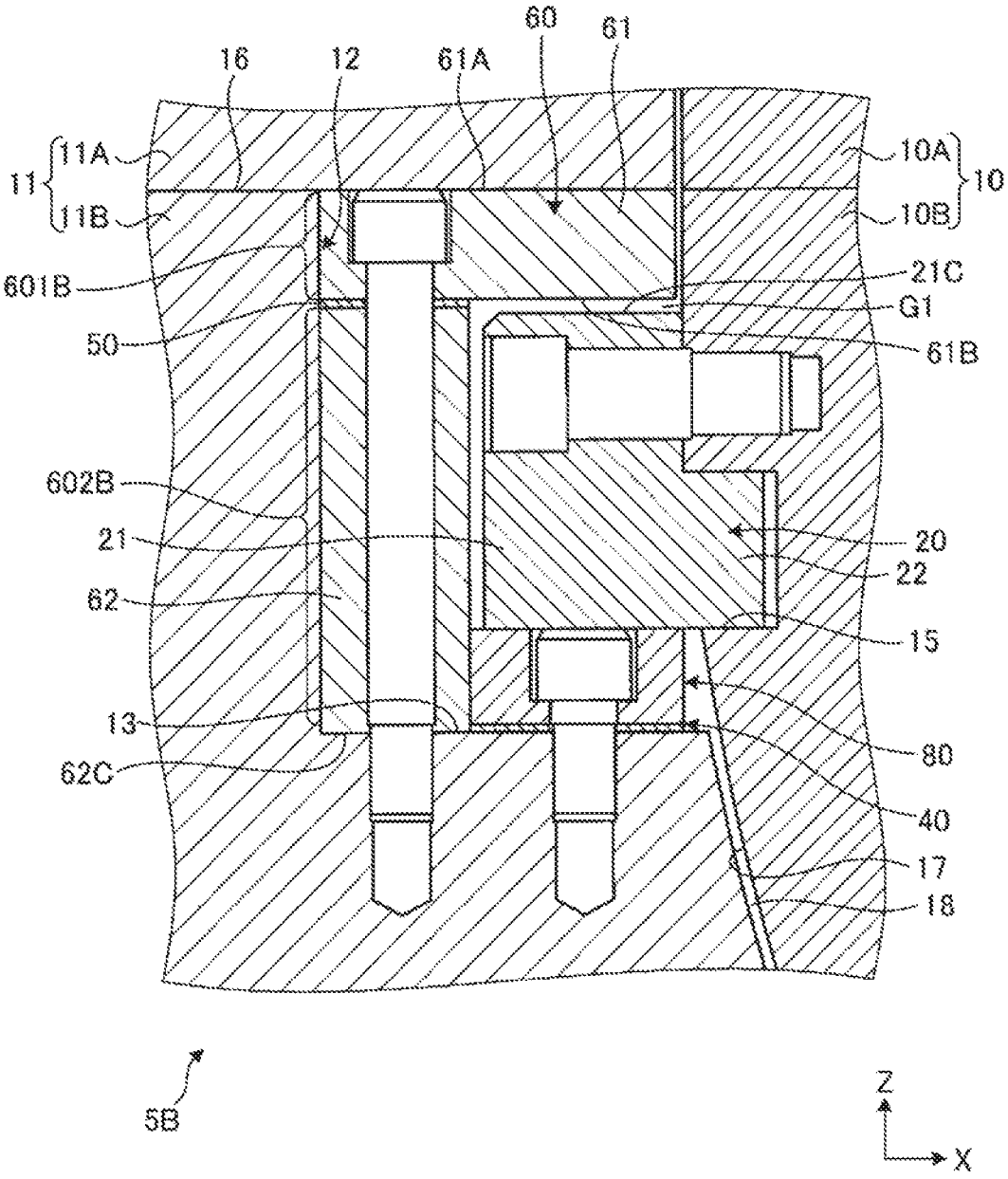
FIG. 7 is a cross-sectional view illustrating a support device according to a third embodiment.

A third embodiment of the present invention will be described below. FIG. 7 is a cross-sectional view illustrating a support device 5B according to the present embodiment. As illustrated in FIG. 7, the upper liner 60 includes a first portion 601B including the upper surface 61A of the horizontal section 61 and a second portion 602B disposed lower than the first portion 601B. In the present embodiment, the first portion 601B is the horizontal section 61, and the second portion 602B is the vertical section 62.

The adjusting shim 40 is disposed between the body 21 and the bottom surface 13 but not between the vertical section 62 and the bottom surface 13. The adjusting shim 50 is disposed between the first portion 601B and the second portion 602B. The adjusting shim 50 adjusts the height of the horizontal section 61 but does not adjust the height of the support member 20.

The upper liner 60 is divided into the horizontal section 61 and the vertical section 62, and the adjusting shim 50 is disposed between the horizontal section 61 and the vertical section 62. Thus, the adjusting shim 50 can be used to adjust both the height of the upper surface 61A of the horizontal section 61 and the height of the lower surface 61B of the horizontal section 61. The height of the lower surface 61B of the horizontal section 61 is adjusted to adjust the dimension of the first gap G1.

Fourth Embodiment

Figure 8:
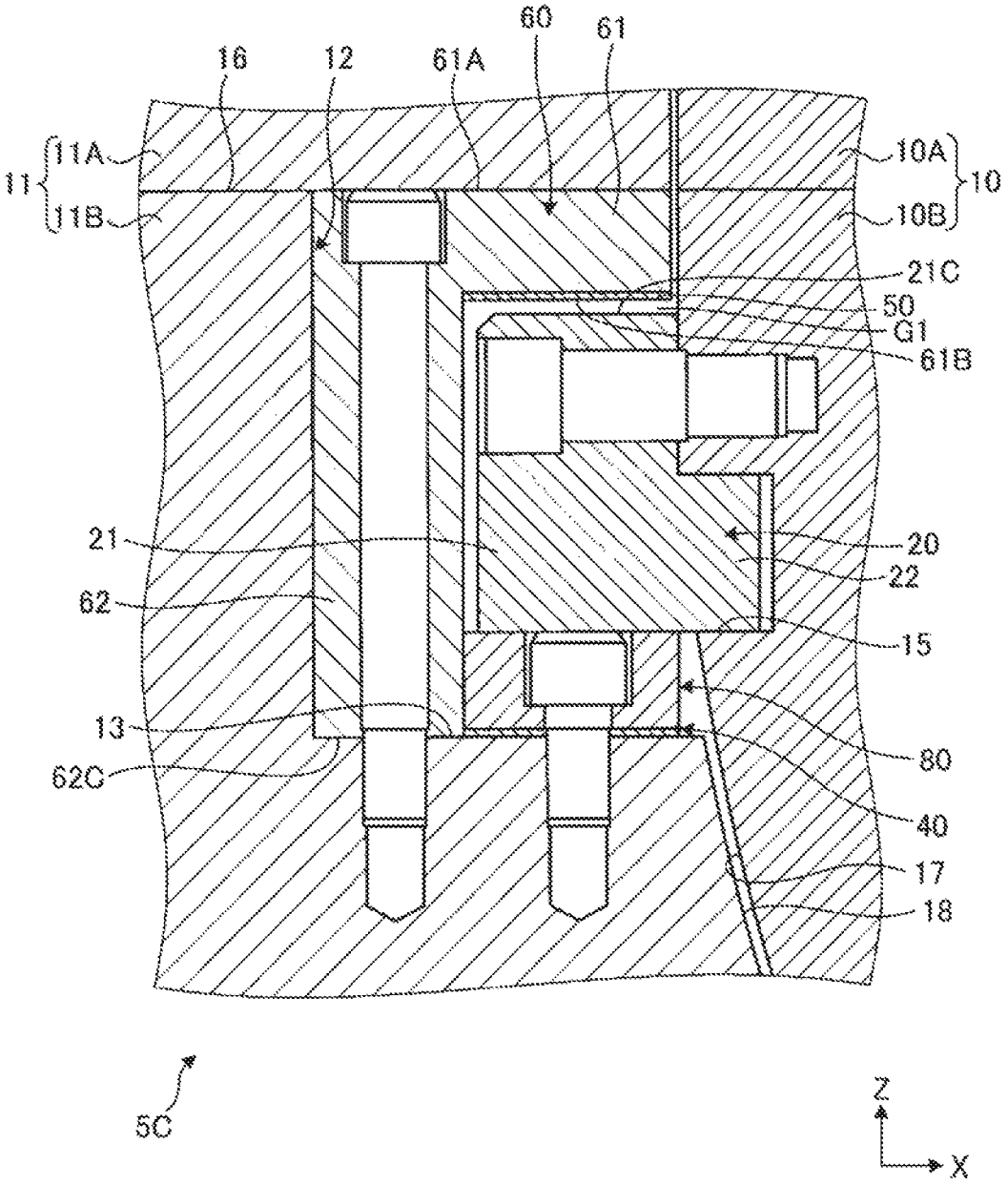
FIG. 8 is a cross-sectional view illustrating a support device according to a fourth embodiment.

A fourth embodiment of the present invention will be described below. FIG. 8 is a cross-sectional view illustrating a support device 5C according to the present embodiment. As illustrated in FIG. 8, the upper liner 60 is provided with the adjusting shim 50 adjusting the height of the lower surface 61B of the horizontal section 61. The adjusting shim 50 affixed to the lower surface 61B of the horizontal section 61 adjusts the height of the lower surface 61B of the horizontal section 61. In the present embodiment, the lower surface of the adjusting shim 50 functions as the lower surface 61B of the horizontal section 61 defining the first gap G1 between itself and the upper surface 21C of the body 21.

Fifth Embodiment

Figure 9:
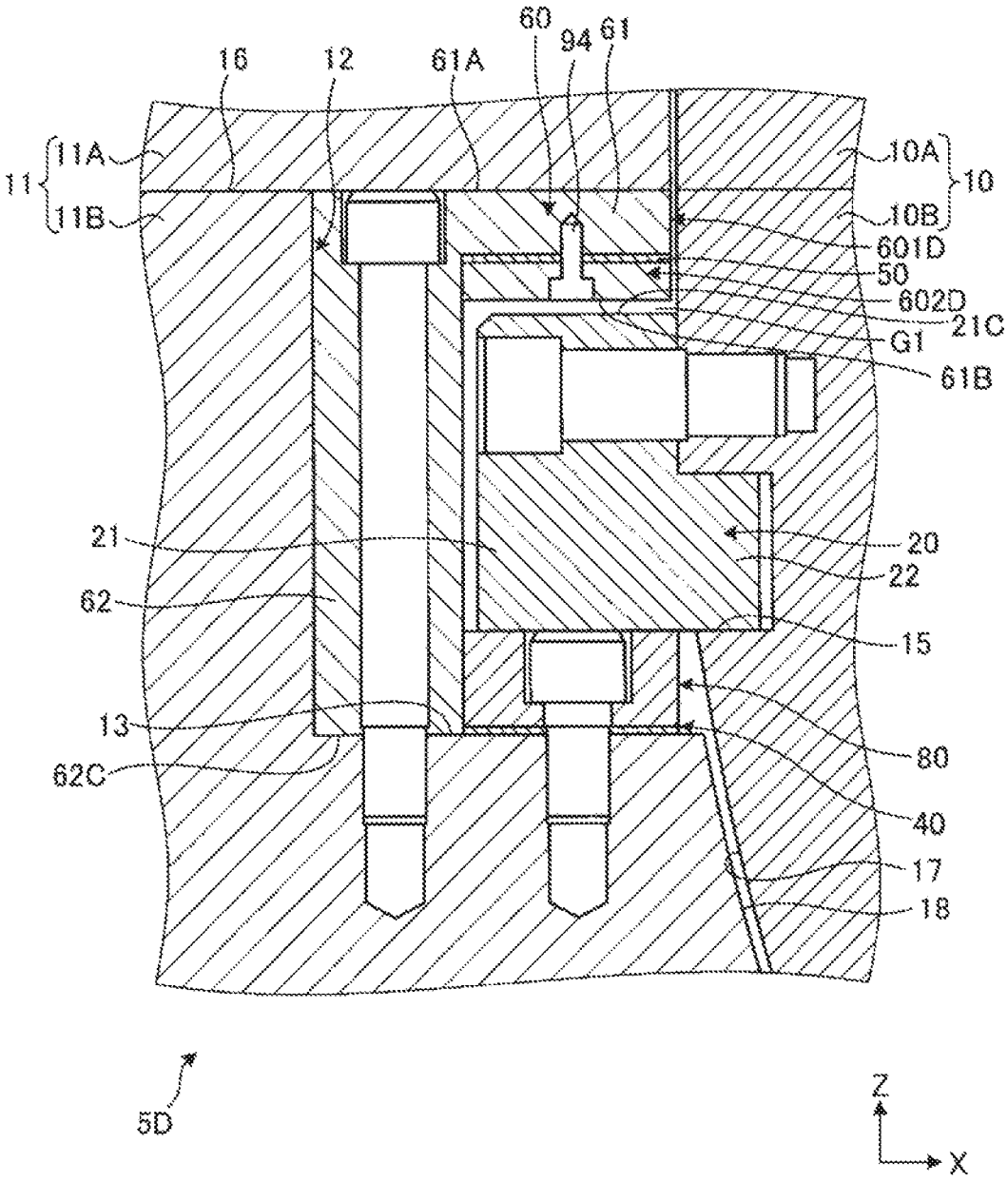
FIG. 9 is a cross-sectional view illustrating a support device according to a fifth embodiment.

A fifth embodiment of the present invention will be described below. FIG. 9 is a cross-sectional view illustrating a support device 5D according to the present embodiment. As illustrated in FIG. 9, the upper liner 60 includes a first portion 601D having the upper surface 61A of the horizontal section 61 and a second portion 602D. The first portion 601D is at least partially disposed above the second portion 602D. In the present embodiment, the horizontal section 61 is divided into the first portion 601D and the second portion 602D. The first portion 601D includes the upper surface 61A of the horizontal section 61, and the second portion 602D includes the lower surface 61B of the horizontal section 61.

The adjusting shim 50 is disposed between the first portion 601D and the second portion 602D. The adjusting shim 50 and second portion 602D are affixed to the first portion 601D with a bolt 94. The thickness of the adjusting shim 50 is adjusted to adjust the height of the lower surface 61B of the horizontal section 61 and to adjust the dimension of the first gap G1 between the lower surface 61B and the upper surface 21C.

Sixth Embodiment

Figure 10:
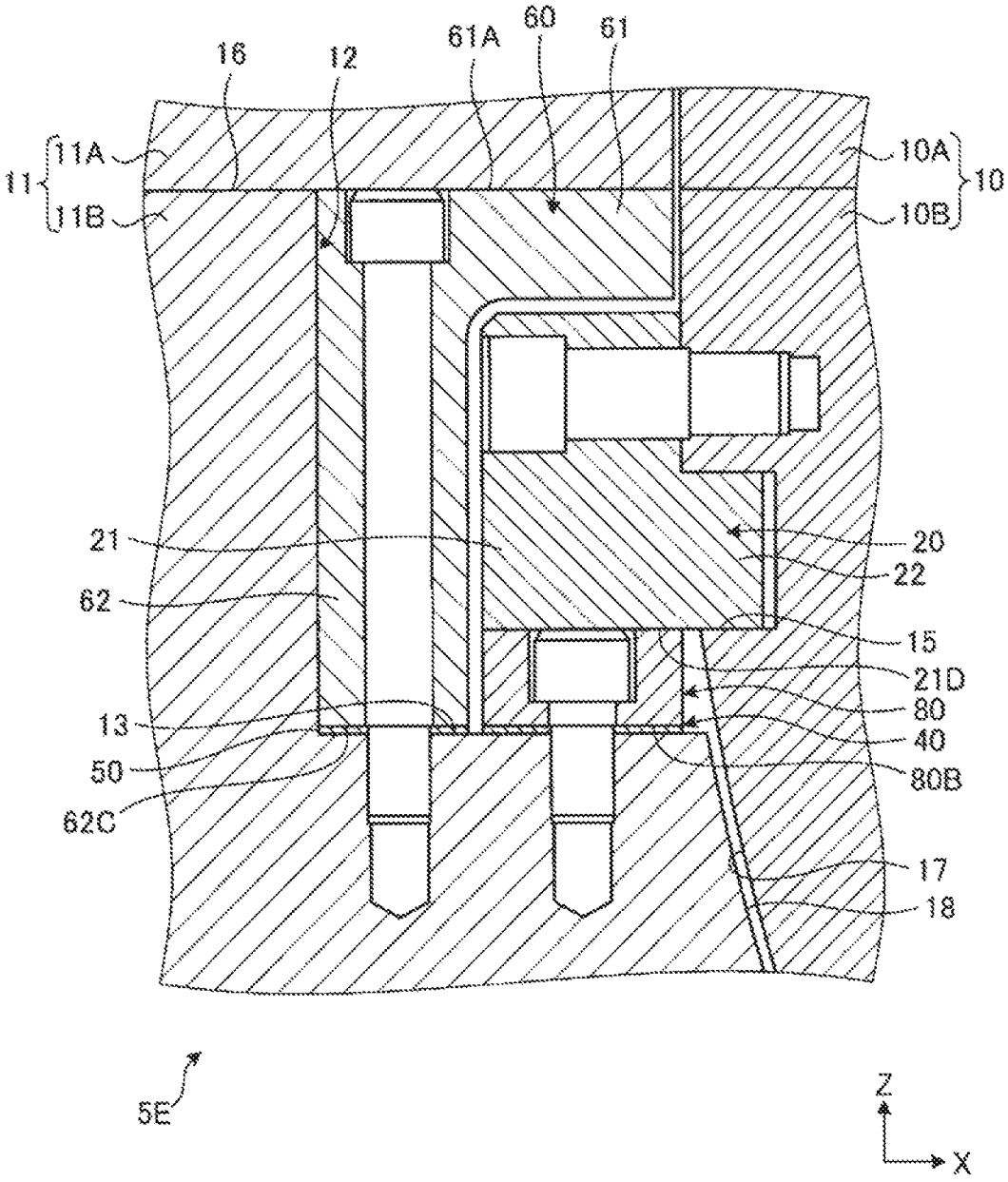
FIG. 10 is a cross-sectional view illustrating a support device according to a sixth embodiment.

A sixth embodiment of the present invention will be described below. FIG. 10 is a cross-sectional view illustrating a support device 5E according to the present embodiment. As illustrated in FIG. 10, the support device 5E includes the adjusting shim 40 adjusting the height of the support member 20 and the adjusting shim 50 adjusting the height of the horizontal section 61. The adjusting shim 40 and the adjusting shim 50 are separate members. The adjusting shim 40 is disposed between the bottom surface 13 of the recess 12 and the lower surface 21D of the body 21 and comes into contact with the lower surface 80B of the lower liner 80 and the bottom surface 13. The adjusting shim 50 is disposed between the bottom surface 13 of the recess 12 and the lower surface 62C, facing the bottom surface 13, of the vertical section 62 and comes into contact with the bottom surface 13 and the lower surface 62C. According to the present embodiment, the height of the support member 20 and the height of the horizontal section 61 can be adjusted separately. The thickness of the adjusting shim 50 is adjusted on the basis of the thickness of the adjusting shim 40, and thus the first gap G1 and the position of the upper surface 61A with respect to the upper surface 16 can be adjusted. The upper surface 61A may be adjusted through cutting.

Seventh Embodiment

Figure 11:
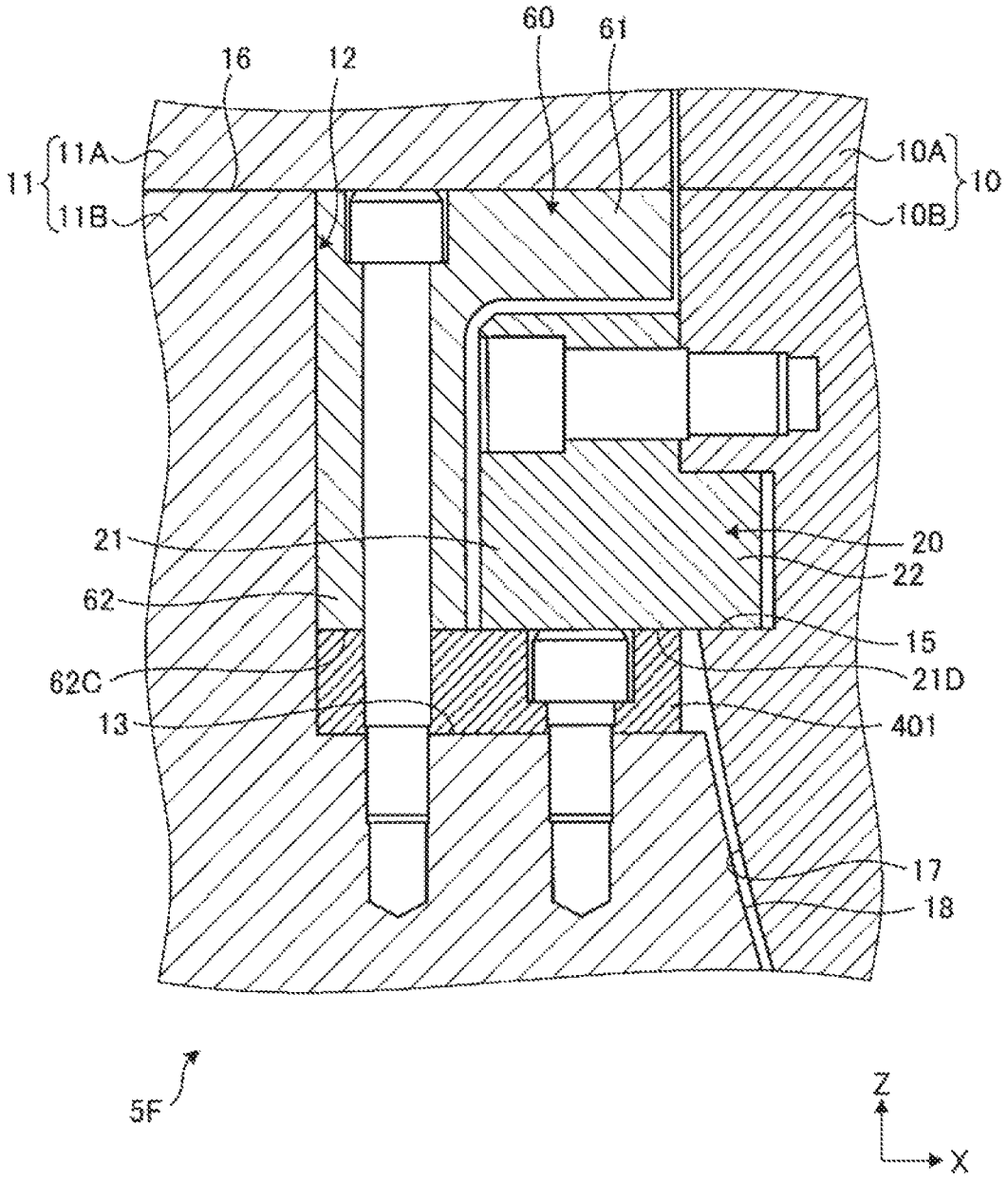
FIG. 11 is a cross-sectional view illustrating a support device according to a seventh embodiment.

A seventh embodiment of the present invention will be described below. FIG. 11 is a cross-sectional view illustrating a support device 5F according to the present embodiment. The support device 5F includes an adjusting shim 401 disposed between the bottom surface 13 of the recess 12 and the lower surface 21D of the body 21 and adjusting the height of the support member 20. The support device 5F does not include the lower liner 80, and the adjusting shim 401 is disposed so as to come into contact with the lower surface 21D of the body 21. Part of the adjusting shim 401 is also disposed between the lower surface 62C of the vertical section 62 and the bottom surface 13 and adjusts the height of the horizontal section 61. The lower liner 80 may be omitted by using the thick adjusting shim 401 in this way. According to the present embodiment, the number of components can be reduced.

Eighth Embodiment

Figure 12:
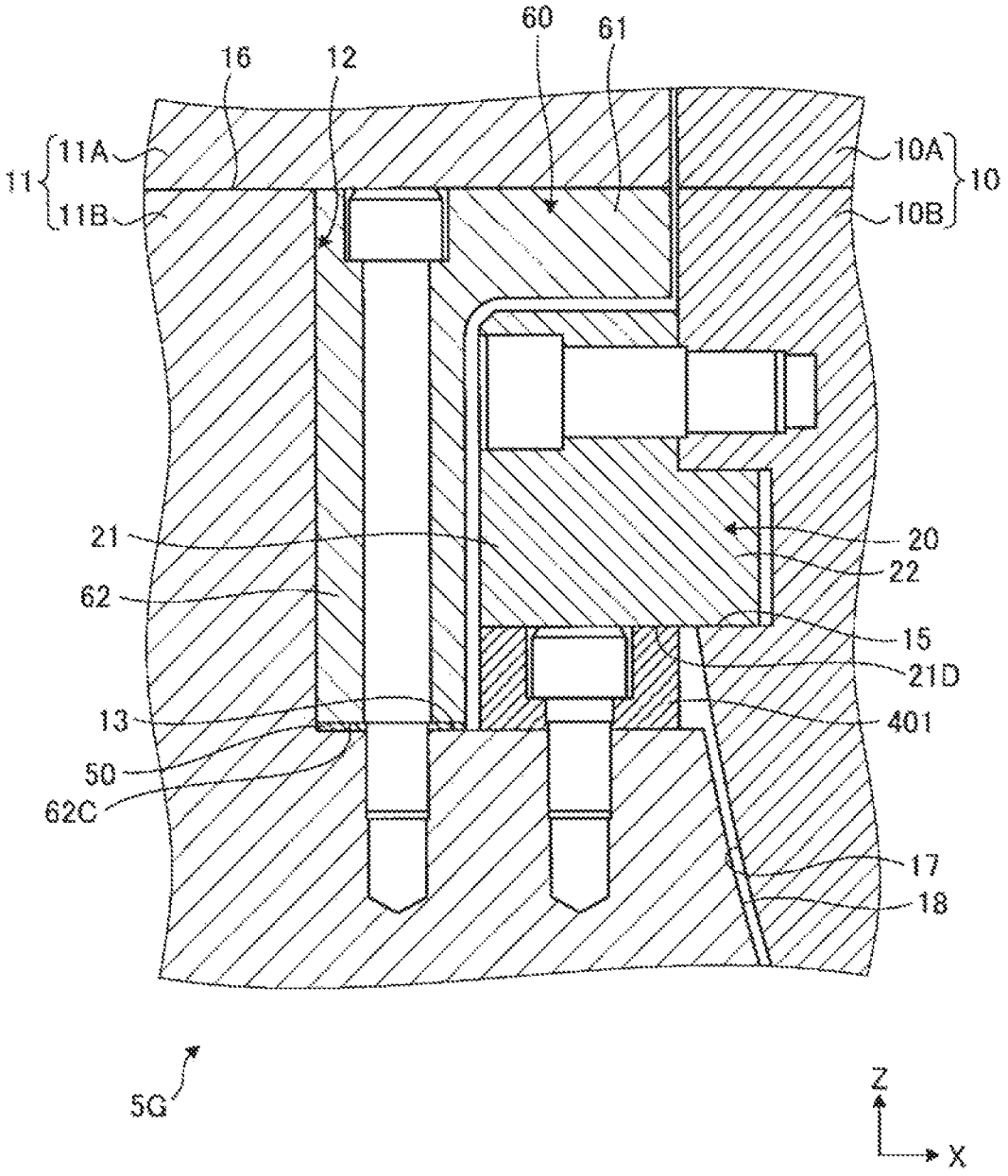
FIG. 12 is a cross-sectional view illustrating a support device according to an eighth embodiment.

An eighth embodiment of the present invention will be described below. FIG. 12 is a cross-sectional view illustrating a support device 5G according to the present embodiment. The support device 5G does not include the lower liner 80 but includes the adjusting shim 401 adjusting the height of the support member 20. The support device 5G includes the adjusting shim 50 that is a member separate from the adjusting shim 401 and adjusts the height of the horizontal section 61.

The adjusting shim 401 is disposed between the bottom surface 13 and the lower surface 21D and comes into contact with the bottom surface 13 and the lower surface 21D. The adjusting shim 50 is disposed between the bottom surface 13 and the lower surface 62C of the vertical section 62 and comes into contact with the bottom surface 13 and the lower surface 62C. In this way, both the thick adjusting shim 401 and the adjusting shim 50 being a member separate from the adjusting shim 401 may be used.

Ninth Embodiment

Figure 13:
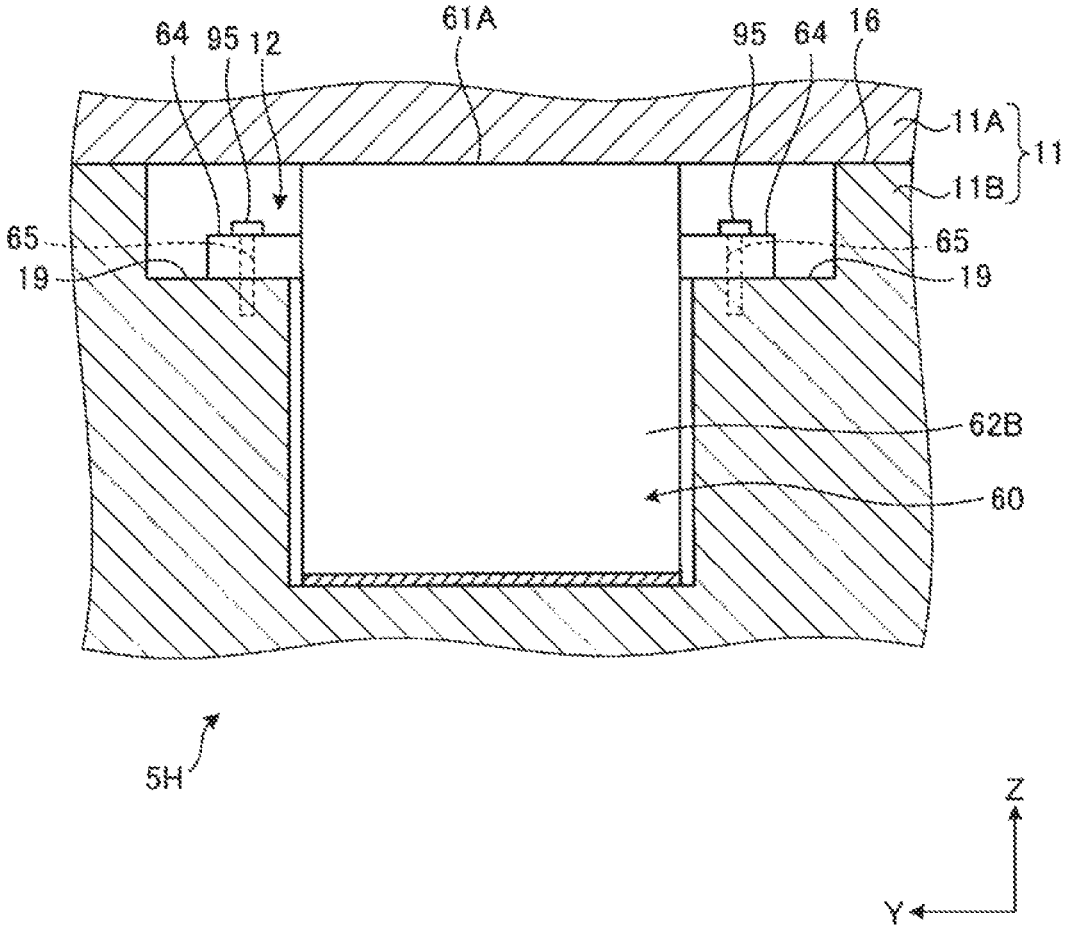
FIG. 13 is a view illustrating a support device according to a ninth embodiment.
Figure 14:
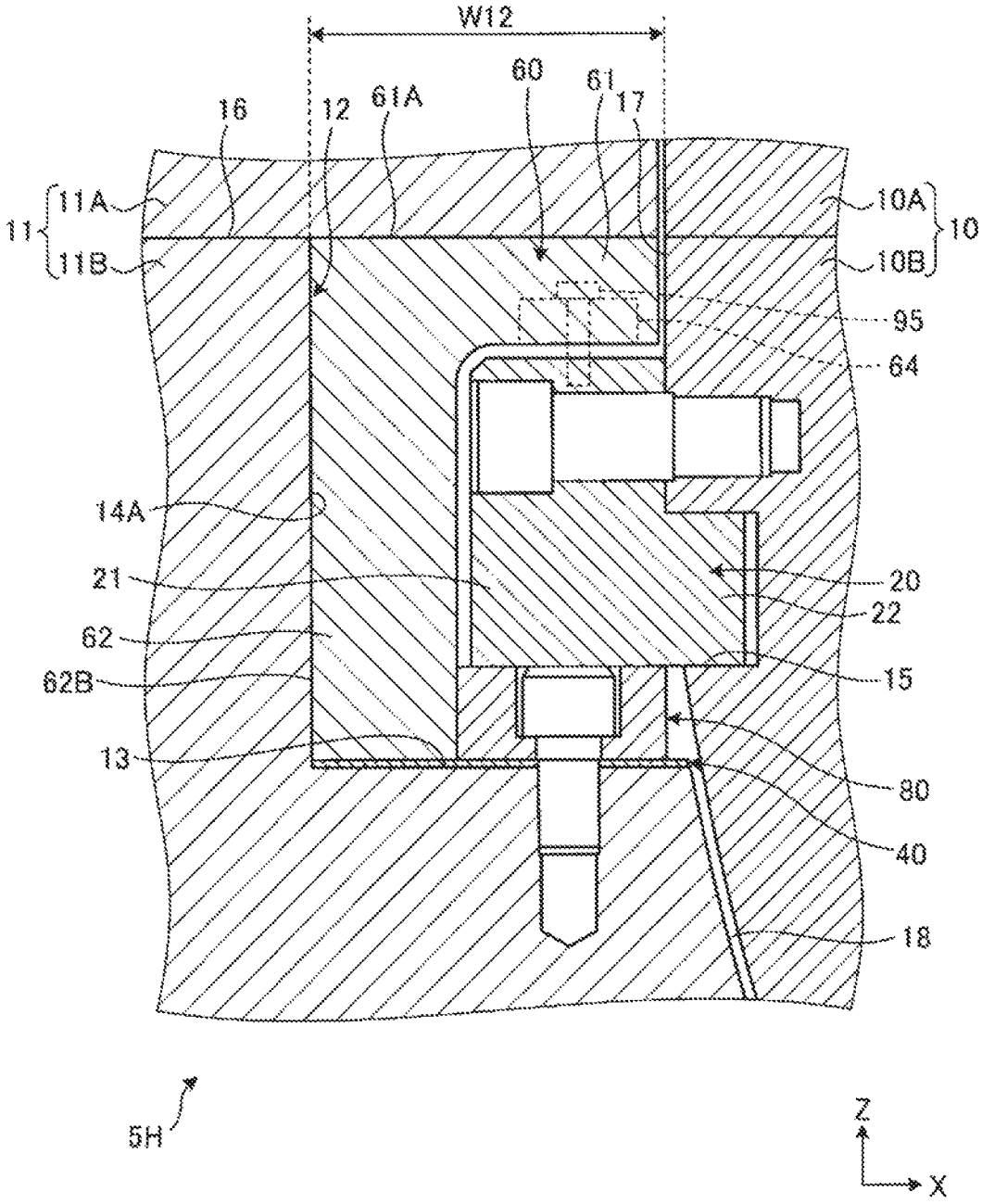
FIG. 14 is a cross-sectional view illustrating the support device according to the ninth embodiment.

A ninth embodiment of the present invention will be described below. FIG. 13 is a view, from the rear surface 62B, illustrating the upper liner 60 of a support device 5H according to the present embodiment, and FIG. 14 is a cross-sectional view illustrating the support device 5H. The upper liner 60 includes sticking-out portions 64 sticking out from the horizontal section 61 in the Y-axis direction. The recess 12 of the lower half 11B is provided with support surfaces 19 facing the lower surfaces of the sticking-out portions 64. The sticking-out portions 64 are supported by the support surfaces 19 and affixed to the lower half 11B with bolts 95.

In this way, the upper liner 60 may be affixed to the lower half 11B with the bolts 95 disposed in bolt holes 65 penetrating the upper surfaces and the lower surfaces of the sticking-out portions 64, instead of the bolt 92 disposed in the bolt hole 63 of the vertical section 62. The upper surface 61A may be adjusted through cutting. According to the present embodiment, the horizontal distance W12 between the inner wall surface 14A of the recess 12 and the outer surface 17 of the lower half 10B can be shortened, and thus the size of the casing 11 can be made compact.

Tenth Embodiment

Figure 15:
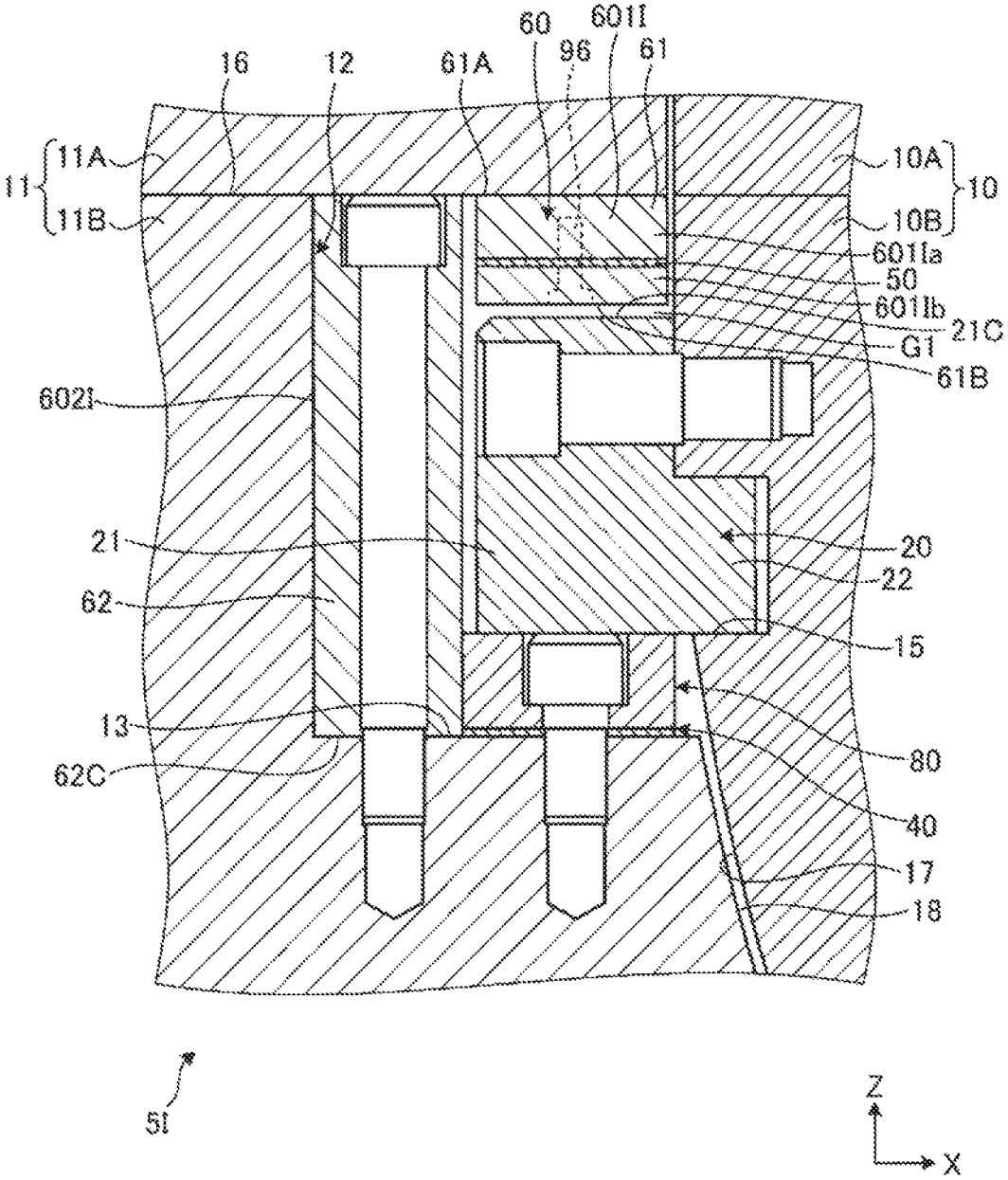
FIG. 15 is a cross-sectional view illustrating a support device according to a tenth embodiment.

A tenth embodiment of the present invention will be described below. FIG. 15 is a cross-sectional view illustrating a support device 51 according to the present embodiment. The upper liner 60 is divided into a first portion 601I including the upper surface 61A of the horizontal section 61 and a second portion 602I including the lower surface 62C. The second portion 602I is at least partially positioned lower than the first portion 601I.

The first portion 601I is divided into a portion 601Ia including the upper surface 61A and a portion 601Ib including the lower surface 61B. The adjusting shim 50 adjusting the height of the horizontal section 61 is disposed between the portion 601Ia and the portion 601Ib. The adjusting shim 50 adjusts the height of the upper surface 61A and the height of the lower surface 61B. The portion 601Ia, adjusting shim 50, and portion 601Ib are affixed to each other with a bolt 96. The first portion 601I including the portion 601Ia, portion 601Ib, and adjusting shim 50 is provided with the sticking-out portions described with reference to FIG. 13 and is affixed to the lower half 11B through the sticking-out portions.

The rotary machine is a steam turbine in each of the above-described embodiments. However, the rotary machine may be a gas turbine.

REFERENCE SIGNS LIST

1 Steam turbine (Rotary machine)
2 Rotor (Rotating body)
3 Stationary body
4 Vane
5 Support device
10 Blade ring (Inner member)
10A Upper half (Upper half of inner member)
10B Lower half (Lower half of inner member)
11 Casing (Outer member)
11A Upper half (Upper half of outer member)
11B Lower half (Lower half of outer member)
12 Recess
13 Bottom surface
14A Inner wall surface

14B Inner wall surface
14C Inner wall surface
15 Hole
15A Inner wall surface
15B Inner wall surface
16 Upper surface
17 Outer surface
18 Inner surface
19 Support surface
20 Support member
21 Body
21A Front surface
21B Rear surface
21C Upper surface
21D Lower surface
22 Protrusion
22A Upper surface
22B Lower surface
22C Front surface
23 Bolt hole
40 Adjusting shim (First adjustment member)
40A Upper surface
40B Lower surface
50 Adjusting shim (Second adjustment member)
60 Upper liner
61 Horizontal section
61A Upper surface
61B Lower surface
61C Front surface
62 Vertical section
62A Front surface
62B Rear surface
62C Lower surface
63 Bolt hole
64 Sticking-out portion
65 Bolt hole
80 Lower liner
80A Upper surface
80B Lower surface
80C Front surface
80D Rear surface
83 Bolt hole
91 Bolt
92 Bolt
93 Bolt
94 Bolt
95 Bolt
96 Bolt
100 Frame
200 Support mechanism
401 Adjusting shim (First adjustment member)
601 First portion
601B First portion
601D First portion
601I First portion
602 Second portion
602B Second portion
602D Second portion
602I Second portion
AX Rotation axis
W12 Distance
W20 Dimension
W22 Dimension
W62 Dimension

The invention claimed is:

1. A support device for a rotary machine comprising a stationary body disposed on a periphery of a rotating body rotating about a rotation axis, the stationary body comprising an outer member and an inner member capable of being divided vertically, the support device supporting the inner member on the outer member, the support device comprising:

a support member comprising a body disposed in a recess provided in an upper surface of a lower half of the outer member, and a protrusion provided on the body, the protrusion protruding toward a lower half of the inner member from a front surface facing the lower half of the inner member, the protrusion being disposed removably in a hole provided in the lower half of the inner member;

a first adjustment member disposed between a bottom surface of the recess and a lower surface, facing the bottom surface, of the body; and an upper liner comprising a horizontal section disposed above the body and facing an upper surface of the body with a first gap therebetween, and a vertical section disposed between an inner wall surface, facing inward in a radial direction with respect to the rotation axis, of the recess and a rear surface, facing the inner wall surface, of the body, the upper liner being affixed to the lower half of the outer member, a distance from the inner wall surface of the recess to an outer surface, located facing the inner wall surface, of the lower half of the inner member being greater than an outside dimension of the support member measured in a horizontal direction orthogonal to the rotation axis.

2. The support device according to claim 1, further comprising a second adjustment member adjusting a height of the horizontal section.

3. The support device according to claim 2, wherein the second adjustment member is disposed between the bottom surface of the recess and a lower surface, facing the bottom surface, of the vertical section.

4. The support device according to claim 2, wherein the first adjustment member and the second adjustment member are formed as a single member.

5. The support device according to claim 2, wherein:

the upper liner is divided into a first portion and a second portion disposed lower than at least part of the first portion; and the second adjustment member is disposed between the first portion and the second portion.

6. The support device according to claim 1, wherein the upper liner comprises an upper surface disposed in the same plane as the upper surface of the lower half of the outer member or lower than the upper surface of the lower half of the outer member.

7. The support device according to claim 1, further comprising a lower liner disposed between the body and the first adjustment member and coming into contact with the lower surface of the body.

8. The support device according to claim 1, wherein the vertical section faces the rear surface of the body with a second gap therebetween.

9. The support device according to claim 1, wherein the upper liner is affixed to the lower half of the outer member with a bolt penetrating the upper liner.

10. The support device according to claim 1, wherein the upper liner comprises a bolt hole which penetrates the vertical section in a vertical direction and into which the bolt is inserted.

11. A turbine comprising:

the support device according to claim 1;

the inner member;

the outer member; and the rotating body.

12. A method for assembling a rotary machine comprising a stationary body disposed on a periphery of a rotating body rotating about a rotation axis, the stationary body comprising an outer member and an inner member capable of being divided vertically, the method assembling the rotary machine while the inner member is supported on the outer member, the method comprising the steps of:

arranging a first adjustment member on a bottom surface of a recess provided in an upper surface of a lower half of the outer member;

inserting a support member into the recess, the support member comprising a body and a protrusion protruding toward a lower half of the inner member from a front surface of the body, inserting the protrusion into a hole provided in the lower half of the inner member, and arranging the body above the first adjustment member so that a distance from an inner wall surface, facing inward in a radial direction with respect to the rotation axis, of the recess to a rear surface, facing the inner wall surface, of the body is greater than a dimension of the protrusion measured in a horizontal direction orthogonal to the rotation axis; and inserting an upper liner into the recess, the upper liner comprising a horizontal section extending in the horizontal direction orthogonal to the rotation axis, and a vertical section extending in a vertical direction, arranging the horizontal section above the body so that the horizontal section faces an upper surface of the body with a first gap therebetween, arranging the vertical section between the inner wall surface of the recess and the rear surface of the body, and affixing the upper liner to the lower half of the outer member.

13. The method for assembling a rotary machine according to claim 12, wherein the step of arranging the body above the first adjustment member comprises arranging the protrusion at an opening of the hole and moving the support member in the horizontal direction orthogonal to the rotation axis.

14. The method for assembling a rotary machine according to claim 12, further comprising a step of adjusting a height of the horizontal section.

15. The method for assembling a rotary machine according to claim 14, wherein the step of adjusting the height of the horizontal section comprises, after the upper liner is arranged in the recess, adjusting a height of an upper surface of the horizontal section with respect to the upper surface of the lower half of the outer member.

16. A method for disassembling a rotary machine comprising a stationary body disposed on a periphery of a rotating body rotating about a rotation axis, the stationary body comprising an outer member and an inner member capable of being divided vertically, the rotary machine further comprising a support device supporting the inner member on the outer member;

the support device comprising:

a support member comprising a body disposed in a recess provided in an upper surface of a lower half of the outer member, and a protrusion protruding toward a lower half of the inner member from a front surface of the body, the protrusion being disposed removably in a hole provided in the lower half of the inner member;

a first adjustment member disposed between a bottom surface of the recess and a lower surface, facing the bottom surface, of the body and adjusting a height of the support member; and an upper liner comprising a horizontal section disposed above the body and facing an upper surface of the body with a first gap therebetween, and a vertical section disposed between an inner wall surface, facing inward in a radial direction with respect to the rotation axis, of the recess and a rear surface, facing the inner wall surface, of the body, the upper liner being affixed to the lower half of the outer member;

the method comprising the steps of:

removing the upper liner from the recess;

moving the support member in a horizontal direction orthogonal to the rotation axis so that the rear surface approaches the inner wall surface, and taking out the protrusion from the hole; and after the protrusion is taken out from the hole, removing the support member from the recess.

* * * * *